US008946534B2

(12) United States Patent
Kakishita

(10) Patent No.: US 8,946,534 B2
(45) Date of Patent: Feb. 3, 2015

(54) ACCOMPANIMENT DATA GENERATING APPARATUS

(75) Inventor: Masahiro Kakishita, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/982,479

(22) PCT Filed: Mar. 14, 2012

(86) PCT No.: PCT/JP2012/056551
§ 371 (c)(1),
(2), (4) Date: Jul. 29, 2013

(87) PCT Pub. No.: WO2012/132901
PCT Pub. Date: Oct. 4, 2012

(65) Prior Publication Data

US 2013/0305907 A1 Nov. 21, 2013

(30) Foreign Application Priority Data

Mar. 25, 2011 (JP) ..... 2011-067938

(51) Int. Cl.
*G10H 1/38* (2006.01)

(52) U.S. Cl.
USPC ..... 84/613; 84/637; 84/669

(58) Field of Classification Search
USPC ..... 84/610, 613, 634, 638, 637, 650, 666, 84/669
See application file for complete search history.

(56) References Cited

U.S. PATENT DOCUMENTS

| | | | | | |
|---|---|---|---|---|---|
| 4,876,937 | A | | 10/1989 | Suzuki | |
| 4,922,797 | A | * | 5/1990 | Chapman | 84/650 |
| 4,941,387 | A | * | 7/1990 | Williams et al. | 84/609 |
| 5,138,926 | A | * | 8/1992 | Stier et al. | 84/615 |
| 5,179,241 | A | * | 1/1993 | Okuda et al. | 84/613 |
| 5,410,098 | A | * | 4/1995 | Ito | 84/613 |
| 5,412,156 | A | * | 5/1995 | Ikeda et al. | 84/635 |
| 5,477,003 | A | * | 12/1995 | Muraki et al. | 434/307 A |

(Continued)

FOREIGN PATENT DOCUMENTS

| | | | |
|---|---|---|---|
| JP | 60-59392 | A | 4/1985 |
| JP | 2900753 | B2 | 3/1999 |

(Continued)

OTHER PUBLICATIONS

International Search Report mailed May 15, 2012, for PCT Application No. PCT/JP2012/056551, filed Mar. 14, 2012, two pages.

*Primary Examiner* — David S. Warren
(74) *Attorney, Agent, or Firm* — Morrison & Foerster LLP

(57) ABSTRACT

An accompaniment data generating apparatus has a storage device 15 for storing a set of phrase waveform data having a plurality of constituent notes which form a chord, and a CPU 9. The CPU 9 carries out a process for separating the set of phrase waveform data having a plurality of constituent notes which form a chord into a plurality of sets of phrase waveform data each having different one of the chord constituent notes, an obtaining process for obtaining chord information by which a chord type and a chord root are identified, and a chord note phrase generating process for pitch-shifting one or more of the separated phrase waveform data sets in accordance with chord type and combining the separated phrase waveform data sets including the pitch-shifted phrase waveform data to generate waveform data indicative of a chord note phrase as accompaniment data.

20 Claims, 8 Drawing Sheets

(56) References Cited

U.S. PATENT DOCUMENTS

| | | | | |
|---|---|---|---|---|
| 5,518,408 | A * | 5/1996 | Kawashima et al. | 434/307 A |
| 5,563,361 | A | 10/1996 | Kondo et al. | |
| 5,693,903 | A * | 12/1997 | Heidorn et al. | 84/668 |
| 8,338,686 | B2 * | 12/2012 | Mann et al. | 84/609 |
| 2009/0064851 | A1 * | 3/2009 | Morris et al. | 84/637 |
| 2010/0192755 | A1 * | 8/2010 | Morris et al. | 84/637 |
| 2013/0025437 | A1 * | 1/2013 | Serletic et al. | 84/634 |
| 2013/0305902 | A1 * | 11/2013 | Okazaki et al. | 84/604 |
| 2013/0305907 | A1 * | 11/2013 | Kakishita | 84/613 |

FOREIGN PATENT DOCUMENTS

| | | | |
|---|---|---|---|
| JP | 2004-021027 | A | 1/2004 |
| JP | 2006-126697 | A | 5/2006 |
| JP | 4274272 | B2 | 3/2009 |
| JP | 2009-156914 | A | 7/2009 |

* cited by examiner

FIG.5

| chord type | root | third | fifth | fourth note |
|---|---|---|---|---|
| maj | 0 | 4 | 7 | – |
| 6 | 0 | 4 | 7 | 9 |
| M7 | 0 | 4 | 7 | 11 |
| m | 0 | 3 | 7 | – |
| m6 | 0 | 3 | 7 | 9 |
| m7 | 0 | 3 | 7 | 10 |
| mM7 | 0 | 3 | 7 | 11 |
| 7 | 0 | 4 | 7 | 10 |
| M7(♭5) | 0 | 4 | 6 | 11 |
| ♭5 | 0 | 4 | 6 | – |
| m7(♭5) | 0 | 3 | 6 | 10 |
| mM7(♭5) | 0 | 3 | 6 | 11 |
| 7(♭5) | 0 | 4 | 6 | 10 |
| aug | 0 | 4 | 8 | – |
| 7aug | 0 | 4 | 8 | 10 |
| M7aug | 0 | 4 | 8 | 11 |
| dim | 0 | 3 | 6 | – |
| dim7 | 0 | 3 | 6 | 9 |
| sus4 | 0 | 5 | 7 | – |
| 7sus4 | 0 | 5 | 7 | 10 |
| 1+8 | 0 | – | – | – |
| 1+5 | 0 | – | 7 | – |

ACCOMPANIMENT DATA GENERATING APPARATUS

CROSS-REFERENCE TO RELATED APPLICATIONS

This application is a National Phase application under 35 U.S.C. §371 of International Application No. PCT/JP2012/056551 filed Mar. 14, 2012, which claims priority benefit of Japanese Patent Application No. 2011-067938 filed Mar. 25, 2011. The contents of the above applications are herein incorporated by reference in their entirety for all intended purposes.

BACKGROUND OF THE INVENTION

1. Field of the Invention

The present invention relates to an accompaniment data generating apparatus and an accompaniment data generation program for generating waveform data indicative of chord note phrases.

2. Description of the Related Art

Conventionally, there is a known automatic accompaniment apparatus which stores sets of accompaniment style data based on automatic performance data such as MIDI format available in various music styles (genres), and adds accompaniment to user's musical performance in accordance with user's (performer's) selected accompaniment style data (see Japanese Patent Publication No. 2900753, for example).

The conventional automatic accompaniment apparatus which uses automatic musical performance data converts tone pitches so that, for example, accompaniment style data based on a chord such as CMaj will match chord information detected from user's musical performance.

Furthermore, there is a known arpeggio performance apparatus which stores arpeggio pattern data as phrase waveform data, adjusts tone pitch and tempo to match user's input performance, and generates automatic accompaniment data (see Japanese Patent Publication No. 4274272, for example).

SUMMARY OF THE INVENTION

Because the above-described automatic accompaniment apparatus which uses automatic performance data generates musical tones by use of MIDI or the like, it is difficult to perform automatic accompaniment in which musical tones of an ethnic musical instrument or a musical instrument using a peculiar scale are used. In addition, because the above-described automatic accompaniment apparatus offers accompaniment based on automatic performance data, it is difficult to exhibit realism of human live performance.

Furthermore, the conventional automatic accompaniment apparatus which uses phrase waveform data such as the above-described arpeggio performance apparatus is able to provide automatic performance only of accompaniment phrases of monophony.

An object of the present invention is to provide an accompaniment data generating apparatus which can generate automatic accompaniment data that uses phrase waveform data including chords.

In order to achieve the above-described object, it is a feature of the present invention to provide an accompaniment data generating apparatus including a storage device (7, 8, 15) for storing a set of phrase waveform data having a plurality of constituent notes which form a chord; a separating portion (9, SA3, SB15) for separating the set of phrase waveform data having the chord constituent notes into sets of phrase waveform data formed of a set of phrase waveform data having at least one of the chord constituent notes and a set of phrase waveform data which does not have the at least one of the chord constituent notes but has different one of the chord constituent notes; an obtaining portion (9, SA19, SA20) for obtaining chord information which identifies chord type and chord root; and a chord note phrase generating portion (9, SA23, SB4 to SB16) for pitch-shifting one or more of the separated phrase waveform data sets in accordance with at least the chord type identified on the basis of the obtained chord information, and combining the separated phrase waveform data sets including the pitch-shifted phrase waveform data to generate, as accompaniment data, a set of waveform data indicative of a chord note phrase corresponding to the chord root and the chord type identified on the basis of the obtained chord information.

In this case, the separating portion may separate the phrase waveform data set having the chord constituent notes into a set of phrase waveform data having two or more of the chord constituent notes and a set of phrase waveform data having one chord constituent note which is included in the chord constituent notes but is different from the two or more of the chord constituent notes. Furthermore, the set of phrase waveform data which is separated by the separating portion and has the two or more chord constituent notes may have chord constituent notes which are a chord root, a note having an interval of a third, and a note having an interval of a fifth, chord constituent notes which are the chord root and the note having the interval of the fifth, or chord constituent notes which are the chord root and the note having the interval of the third.

Furthermore, the separating portion may have a conditional separating portion (9, SB15) for separating, if one set of phrase waveform data has both a chord constituent note defined by the chord type identified on the basis of the chord information obtained by the obtaining portion and a chord constituent note which is not defined by the chord type, the one set of phrase waveform data into a set of phrase waveform data having the chord constituent note defined by the chord type and a set of phrase waveform data having the chord constituent note which is not defined by the chord type.

Furthermore, the separating portion may separate the set of phrase waveform data into a plurality of phrase waveform data sets each corresponding to different one of the chord constituent notes.

Furthermore, the storage device may store one set of phrase waveform data having a plurality of constituent notes of a chord; and the chord note phrase generating portion may include a first pitch-shifting portion for pitch-shifting one or more of the phrase waveform data sets separated by the separating portion in accordance not only with the chord type identified on the basis of the chord information obtained by the obtaining portion but also with a difference in tone pitch between a chord root included in the one set of phrase waveform data and the chord root identified on the basis of the chord information obtained by the obtaining portion; a second pitch-shifting portion for pitch-shifting the set of phrase waveform data which has been separated by the separating portion but is different from the one or more phrase waveform data sets in accordance with the difference in tone pitch between the chord root included in the one set of phrase waveform data and the chord root identified on the basis of the chord information obtained by the obtaining portion; and a combining portion for combining the phrase waveform data pitch-shifted by the first pitch-shifting portion and the phrase waveform data pitch-shifted by the second pitch-shifted portion.

Furthermore, the storage device may store one set of phrase waveform data having a plurality of constituent notes of a chord; and the chord note phrase generating portion may include a first pitch-shifting portion for pitch-shifting one or more of the phrase waveform data sets separated by the separating portion in accordance with the chord type identified on the basis of the chord information obtained by the obtaining portion; a combining portion for combining the one or more of the phrase waveform data sets pitch-shifted by the first pitch-shifting portion and phrase waveform data which is included in the phrase waveform data sets separated by the separating portion but is different from the one or more of the phrase waveform data sets; and a second pitch-shifting portion for pitch-shifting the combined phrase waveform data in accordance with a difference in tone pitch between a chord root included in the one set of phrase waveform data and the chord root identified on the basis of the chord information obtained by the obtaining portion.

Furthermore, the storage device may store a plurality of phrase waveform data sets each having a plurality of constituent notes of a different chord; the accompaniment data generating apparatus may further include a selecting portion (9, SA3) for selecting a set of phrase waveform data having a chord root having the smallest difference in tone pitch between the chord root identified on the basis of the chord information obtained by the obtaining portion from among the plurality of phrase waveform data sets; the separating portion may separate the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating portion may include a first pitch-shifting portion for pitch-shifting one or more of the phrase waveform data sets separated by the separating portion in accordance not only with the chord type identified on the basis of the chord information obtained by the obtaining portion but also with a difference in tone pitch between the chord root included in the selected phrase waveform data set and the chord root identified on the basis of the chord information obtained by the obtaining portion; a second pitch-shifting portion for pitch-shifting the set of phrase waveform data which has been separated by the separating portion but is different from the one or more phrase waveform data sets in accordance with the difference in tone pitch between the chord root included in the selected phrase waveform data set and the chord root identified on the basis of the chord information obtained by the obtaining portion; and a combining portion for combining the phrase waveform data pitch-shifted by the first pitch-shifting portion and the phrase waveform data pitch-shifted by the second pitch-shifted portion.

Furthermore, the storage device may store a plurality of phrase waveform data sets each having a plurality of constituent notes of a different chord; the accompaniment data generating apparatus may further include a selecting portion (9, SA3) for selecting a set of phrase waveform data having a chord root having the smallest difference in tone pitch between the chord root identified on the basis of the chord information obtained by the obtaining portion from among the plurality of phrase waveform data sets; the separating portion may separate the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating portion may include a first pitch-shifting portion for pitch-shifting one or more of the phrase waveform data sets separated by the separating portion in accordance with the chord type identified on the basis of the chord information obtained by the obtaining portion; a combining portion for combining the one or more of the phrase waveform data sets pitch-shifted by the first pitch-shifting portion and phrase waveform data which is included in the phrase waveform data sets separated by the separating portion but is different from the one or more of the phrase waveform data sets; and a second pitch-shifting portion for pitch-shifting the combined phrase waveform data in accordance with a difference in tone pitch between the chord root included in the selected phrase waveform data set and the chord root identified on the basis of the chord information obtained by the obtaining portion.

Furthermore, the storage device may store a set of phrase waveform data having a plurality of constituent notes of a chord for every chord root; the accompaniment data generating apparatus may further include a selecting portion (9, SA3) for selecting a set of phrase waveform data corresponding to the chord root identified on the basis of the chord information obtained by the obtaining portion from among the plurality of phrase waveform data sets; the separating portion may separate the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating portion may include a pitch-shifting portion for pitch-shifting one or more of the phrase waveform data sets separated by the separating portion in accordance with the chord type identified on the basis of the chord information obtained by the obtaining portion; and a combining portion for combining the one or more of the phrase waveform data sets pitch-shifted by the pitch-shifting portion and phrase waveform data which is included in the phrase waveform data sets separated by the separating portion but is different from the one or more of the phrase waveform data sets.

According to the present invention, the accompaniment data generating apparatus is able to generate automatic accompaniment data which uses phrase waveform data including chords.

Furthermore, the present invention is not limited to the invention of the accompaniment data generating apparatus, but can be also embodied as inventions of an accompaniment data generation program and an accompaniment data generation method.

BRIEF DESCRIPTION OF THE DRAWINGS

FIG. 5 is a conceptual diagram indicative of an example chord type-organized semitone distance table according to the embodiment of the present invention;

DESCRIPTION OF THE PREFERRED EMBODIMENT

Figure 1:
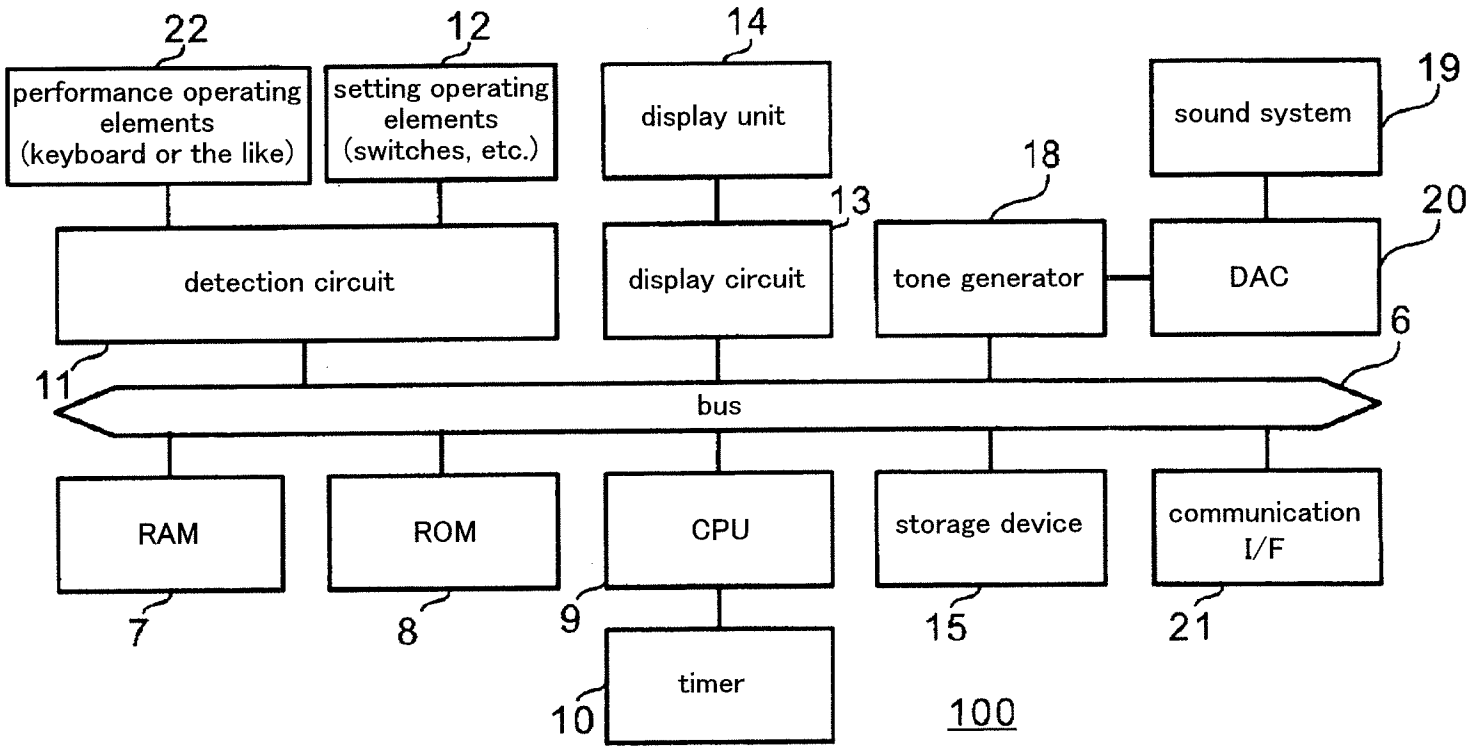
FIG. 1 is a block diagram indicative of an example hardware configuration of an accompaniment data generating apparatus according to an embodiment of the present invention.

FIG. 1 is a block diagram indicative of an example of a hardware configuration of an accompaniment data generating apparatus 100 according to the embodiment of the present invention.

A RAM 7, a ROM 8, a CPU 9, a detection circuit 11, a display circuit 13, a storage device 15, a tone generator 18 and a communication interface (I/F) 21 are connected to a bus 6 of the accompaniment data generating apparatus 100.

The RAM 7 has buffer areas including reproduction buffer and a working area for the CPU 9 in order to store flags, registers, various parameters and the like. For example, automatic accompaniment data which will be described later is to be loaded into an area of the RAM 7.

In the ROM 8, various kinds of data files (later-described automatic accompaniment data AA, for instance), various kinds of parameters, control programs, and programs for realizing the embodiment can be stored. In this case, there is no need to doubly store the programs and the like in the storage device 15.

The CPU 9 performs computations, and controls the apparatus in accordance with the control programs and programs for realizing the embodiment stored in the ROM 8 or the storage device 15. A timer 10 is connected to the CPU 9 to supply basic clock signals, interrupt timing and the like to the CPU 9.

A user uses setting operating elements 12 connected to the detection circuit 11 for various kinds of input, setting and selection. The setting operating elements 12 can be anything such as switch, pad, fader, slider, rotary encoder, joystick, jog shuttle, keyboard for inputting characters and mouse, as long as they are able to output signals corresponding to user's inputs. Furthermore, the setting operating elements 12 may be software switches which are displayed on a display unit 14 to be operated by use of operating elements such as cursor switches.

By using the setting operating elements 12, in the embodiment, the user selects automatic accompaniment data AA stored in the storage device 15, the ROM 8 or the like, or retrieved (downloaded) from an external apparatus through the communication I/F 21, instructs to start or stop automatic accompaniment, and makes various settings.

The display circuit 13 is connected to the display unit 14 to display various kinds of information on the display unit 14. The display unit 14 can display various kinds of information for the settings on the accompaniment data generating apparatus 100.

The storage device 15 is formed of at least one combination of a storage medium such as a hard disk, FD (flexible disk or floppy disk (trademark)), CD (compact disk), DVD (digital versatile disk), or semiconductor memory such as flash memory and its drive. The storage media can be either detachable or integrated into the accompaniment data generating apparatus 100. In the storage device 15 and(or) the ROM 8, preferably a plurality of automatic accompaniment data sets AA, separation pattern data DP including separation waveform data DW correlated with automatic accompaniment data AA, and the programs for realizing the embodiment of the present invention and the other control programs can be stored. In a case where the programs for realizing the embodiment of the present invention and the other control programs are stored in the storage device 15, there is no need to store these programs in the ROM 8 as well. Furthermore, some of the programs can be stored in the storage device 15, with the other programs being stored in the ROM 8.

The tone generator 18 is a waveform memory tone generator, for example, which is a hardware or software tone generator that is capable of generating musical tone signals at least on the basis of waveform data (phrase waveform data). The tone generator 18 generates musical tone signals in accordance with automatic accompaniment data or automatic performance data stored in the storage device 15, the ROM 8, the RAM 7 or the like, or performance signals, MIDI signals, phrase waveform data or the like supplied from performance operating elements (keyboard) 22 or an external apparatus connected to the communication interface 21, adds various musical effects to the generated signals and supplies the signals to a sound system 19 through a DAC 20. The DAC 20 converts supplied digital musical tone signals into analog signals, while the sound system 19 which includes amplifiers and speakers emits the D/A converted musical tone signals as musical tones.

The communication interface 21, which is formed of at least one of a communication interface such as general-purpose wired short distance I/F such as USB and IEEE 1394, and a general-purpose network I/F such as Ethernet (trademark), a communication interface such as a general-purpose I/F such as MIDI I/F and a general-purpose short distance wireless I/F such as wireless LAN and Bluetooth (trademark), and a music-specific wireless communication interface, is capable of communicating with an external apparatus, a server and the like.

The performance operating elements (keyboard or the like) 22 are connected to the detection circuit 11 to supply performance information (performance data) in accordance with user's performance operation. The performance operating elements 22 are operating elements for inputting user's musical performance. More specifically, in response to user's operation of each performance operating element 22, a key-on signal or a key-off signal indicative of timing at which user's operation of the corresponding performance operating element 22 starts or finishes, respectively, and a tone pitch corresponding to the operated performance operating element 22 are input. By use of the musical performance operating element 22, in addition, various kinds of parameters such as a velocity value corresponding to the user's operation of the musical performance operating element 22 for musical performance can be input.

The musical performance information input by use of the musical performance operating elements (keyboard or the like) 22 includes chord information which will be described later or information for generating chord information. The chord information can be input not only by the musical performance operating elements (keyboard or the like) 22 but also by the setting operating elements 12 or an external apparatus connected to the communication interface 21.

Figure 2:
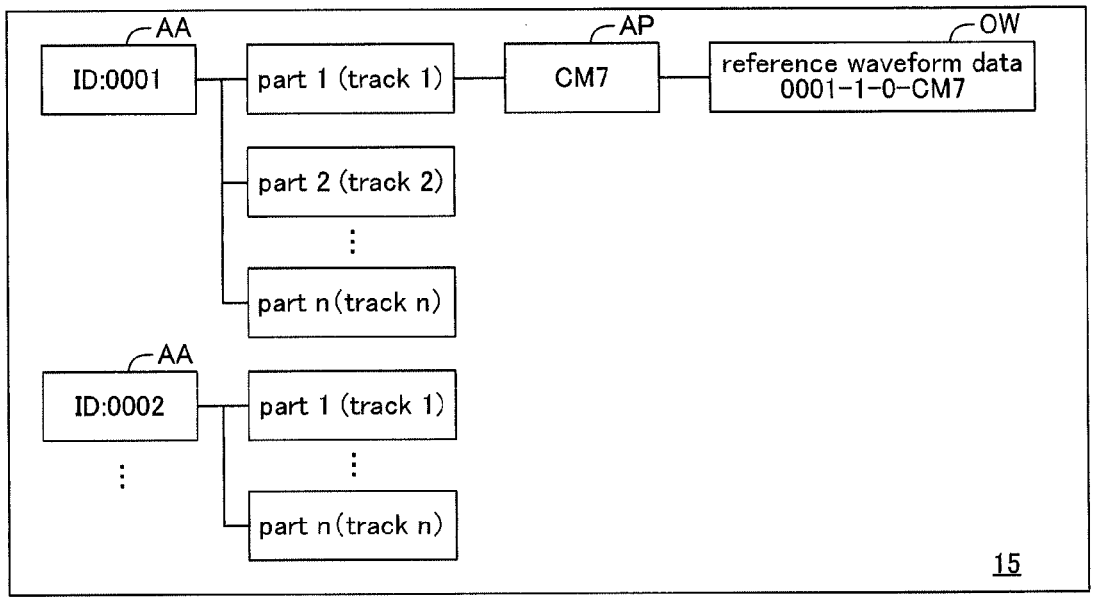
FIG. 2 is a conceptual diagram indicative of an example configuration of automatic accompaniment data used in the embodiment of the present invention.

FIG. 2 is a conceptual diagram indicative of an example configuration of the automatic accompaniment data AA used in the embodiment of the present invention.

Each set of automatic accompaniment data AA has one or more accompaniment parts (tracks) each having at least one set of accompaniment pattern data AP. A set of accompaniment pattern data AP corresponds to one reference tone pitch (chord root) and one chord type, and has a set of reference waveform data OW which is based on the reference tone pitch and the chord type.

A set of automatic accompaniment data AA includes not only substantial data such as accompaniment pattern data AP but also setting information which is related to the entire automatic accompaniment data set and includes an accompaniment style name, time information, tempo information (tempo at which reference waveform data OW is recorded (reproduced)) of the automatic accompaniment data set and information about the corresponding accompaniment part. In a case where a set of automatic accompaniment data AA is formed of a plurality of sections, furthermore, the automatic accompaniment data set AA includes the names of the sections (intro, main, ending, and the like) and the number of measures (e.g., 1 measure, 4 measures, 8 measures, or the like).

The automatic accompaniment data AA according to the embodiment of the invention is data for performing, when the user plays a melody line with the musical performance operating elements 22 indicated in FIG. 1, for example, automatic accompaniment of at least one accompaniment part (track) in accordance with the melody line.

In this embodiment, sets of automatic accompaniment data AA are provided for each of various music genres such as jazz, rock and classic. The sets of automatic accompaniment data AA can be identified by identification number (ID number), accompaniment style name or the like. In this embodiment, sets of automatic accompaniment data AA are stored in the storage device 15 or the ROM 8 indicated in FIG. 1, for example, with each automatic accompaniment data set AA being given an ID number (e.g., "0001", "0002" or the like).

The automatic accompaniment data AA is generally provided for each accompaniment style classified according to rhythm type, musical genre, tempo and the like. Furthermore, each automatic accompaniment data set AA contains a plurality of sections provided for a song such as intro, main, fill-in and ending. Furthermore, each section is configured by a plurality of tracks such as chord track, base track and drum (rhythm) track. For convenience in explanation, however, it is assumed in the embodiment that the automatic accompaniment data set AA is configured by a section having a plurality of accompaniment parts (accompaniment part 1 (track 1) to accompaniment part n (track n)) including at least a chord track for accompaniment which uses chords.

Each accompaniment pattern data AP is applicable to a chord type of a reference tone pitch (chord root), and includes at least one set of reference waveform data OW having constituent notes of the chord type. The accompaniment pattern data AP has not only reference waveform data OW which is substantial data but also attribute information such as reference chord information (reference tone pitch (chord root) information and reference chord type information), recording tempo (in a case where a common recording tempo is provided for all the automatic accompaniment data sets AA, the recording tempo can be omitted), length (time or the number of measures), identifier (ID), name, and the number of included reference waveform data sets OW of the accompaniment pattern data AP. In a case where later-described separation waveform data DW is included, the accompaniment pattern data AP has information indicative of the existence of the separation waveform data DW, attribute of the separation waveform data (information indicative of constituent notes included in the data), the number of included data sets, and the like.

Figure 3:
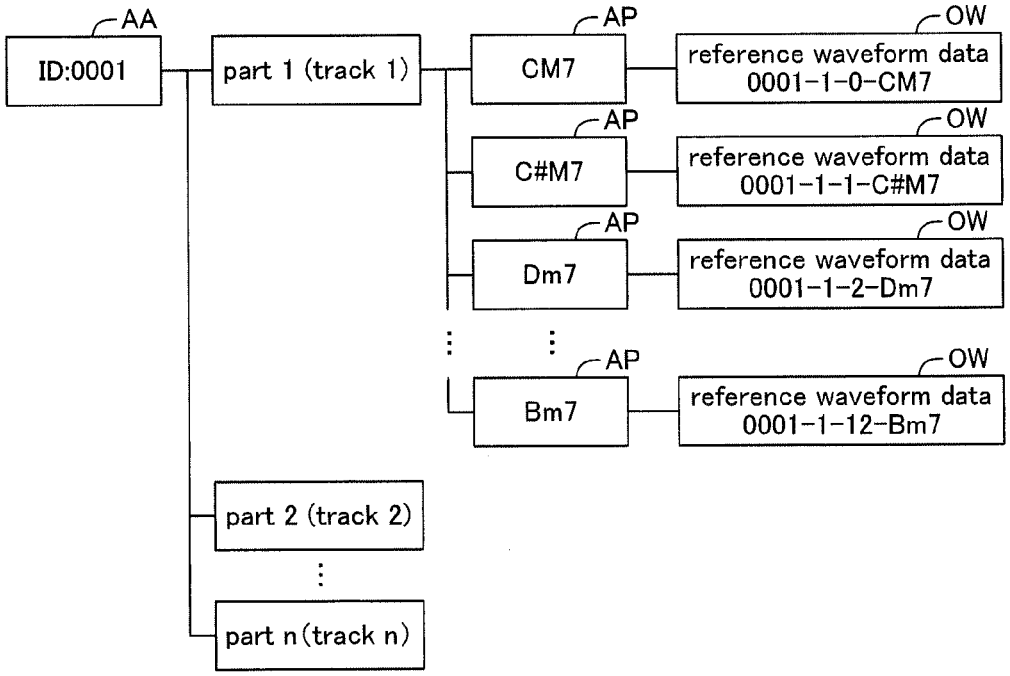
FIG. 3 is a conceptual diagram indicative of a different example configuration of the automatic accompaniment data used in the embodiment of the present invention.

A set of reference waveform data OW is phrase waveform data which stores musical notes corresponding to the performance of an accompaniment phrase based on a chord type and a chord root with which a set of accompaniment data AP correlated with the reference waveform data set OW is correlated. The set of reference waveform data OW has the length of one or more measures. For instance, a set of reference waveform data OW based on CM7 is waveform data in which musical notes (including accompaniment other than chord accompaniment) played mainly by use of tone pitches C, E, G and B which form the CM7 chord are digitally sampled and stored. Furthermore, there can be sets of reference waveform data OW each of which includes tone pitches (which are not the chord notes) other than the notes which form the chord (the chord specified by a combination of a chord type and a chord root) on which the reference waveform data set OW is based. In this embodiment, as indicated in FIG. 2, a set of reference waveform data OW based on "C" which is the reference tone pitch (chord root) and "M7" which is the reference chord type is provided. As indicated in FIG. 3, however, a different set of accompaniment pattern data AP may be provided for every chord root (12 notes). In this case, each chord root may be applicable to a different chord type. For example, a chord root "C" may be correlated with a chord type "M7", while a chord root "D" may be correlated with a chord type "m7". Furthermore, a different set of accompaniment pattern data AP may be provided not for every chord root but for some of the chord roots (2 to 11 notes).

Furthermore, each set of reference waveform data OW has an identifier by which the reference waveform data set OW can be identified. In this embodiment, each set of reference waveform data OW has an identifier having a form "ID (style number) of automatic accompaniment data AA-accompaniment part(track) number-number indicative of a chord root (chord root information)-chord type name (chord type information)". By employing a manner other than the above-described manner in which identifiers are used, attribute information may be provided for each set of reference waveform data OW.

Furthermore, the reference waveform data OW may be stored in the automatic accompaniment data AA. Alternatively, the reference waveform data OW may be stored separately from the automatic accompaniment data AA which stores only information indicative of link to the reference waveform data OW.

In the example shown in FIG. 2, a set of reference waveform data OW including four notes (first to fourth notes) is provided as the reference waveform data OW. However, a set of reference waveform data OW including only three notes, five notes or six notes may be provided as the reference waveform data OW.

In this embodiment, the chord root information and the chord type information is previously stored as attribute information. However, the chord root information and the chord type information may be detected by analyzing accompaniment pattern data.

Figure 4:
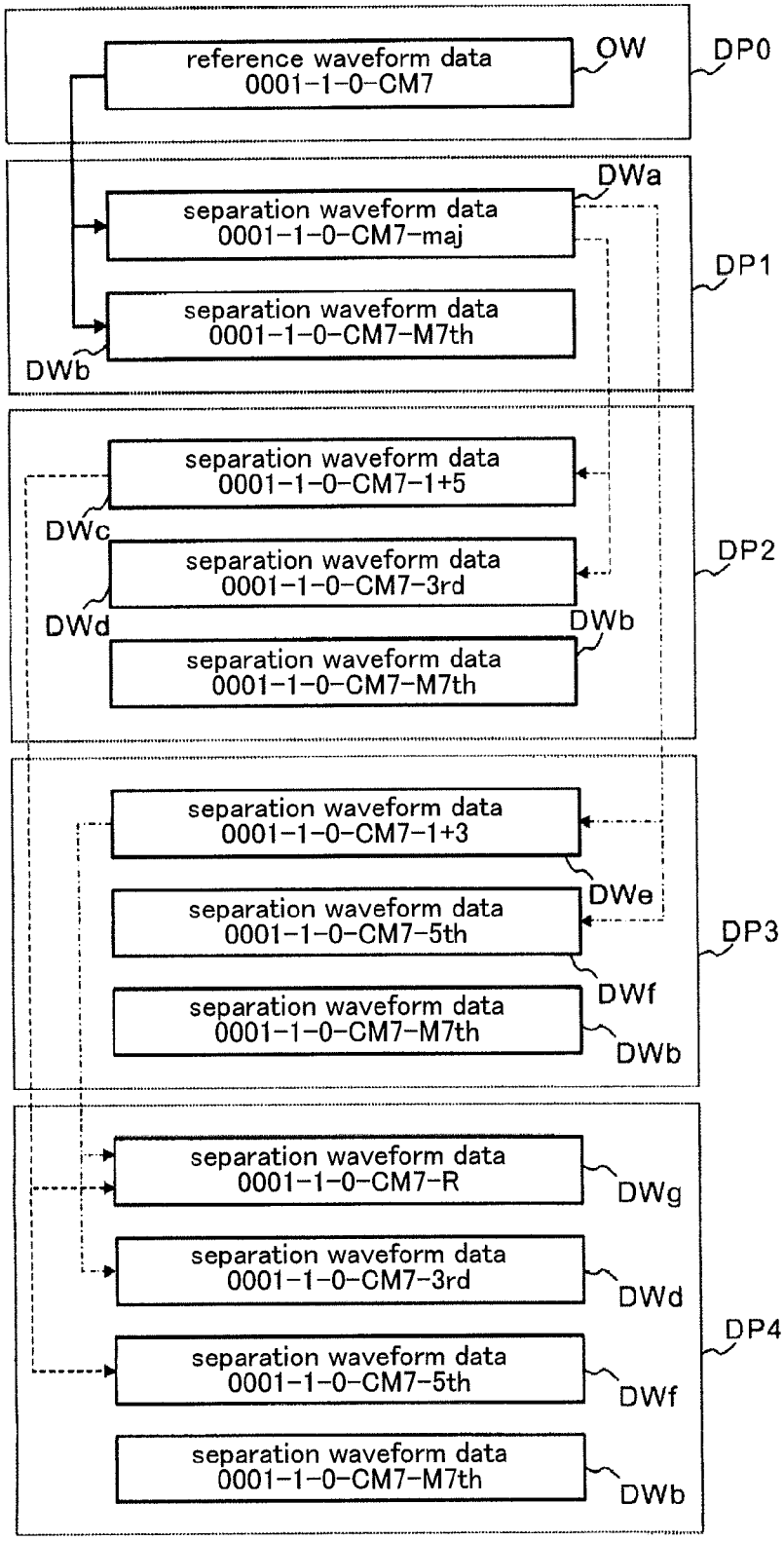
FIG. 4 is a conceptual diagram indicative of separation waveform data according to the embodiment of the present invention.

FIG. 4 is a conceptual diagram indicative of separation waveform data according to the embodiment of the present invention.

In this embodiment, components only of a specified constituent note and its overtones are separated from a set of reference waveform data OW to generate a set of separation waveform data DW corresponding to the specified constituent note.

The separation waveform data DW is separated from the reference waveform data OW by separation processing. The separation processing is done by a known art such as described in DESCRIPTION OF THE PREFERRED EMBODIMENT (particularly, paragraphs [0014] to [0016], and [0025] to [0027]) of Japanese Unexamined Patent Publication No. 2004-21027). What is described in the Japanese Unexamined Patent Publication No. 2004-21027 is incorporated in this specification of the present invention. For instance, a musical tone waveform signal represented by the reference waveform data OW is spectrally analyzed at each frame of a specified time to extract line spectral components corresponding to the fundamental frequency and its harmonic frequencies included in the musical tone waveform. Then, data forming trajectories is tracked and extracted on the basis of peak data included in the extracted line spectral components to generate pitch trajectory, amplitude trajectory and phase trajectory for each frequency component. More specifically, the time series continuance of each frequency component is detected to extract as trajectory. On the basis of the generated pitch trajectory and amplitude trajectory of the frequency component, furthermore, a sinusoidal signal of the frequency corresponding to the each frequency component is generated to combine the generated sinusoidal signals of the frequency components to generate a deterministic wave to subtract the deterministic wave from the original musical tone waveform to obtain a residual wave. The trajectories of the frequency components and the residual wave are analyzed data. Then, by extracting, from the analyzed data on the frequency components obtained by the above-described musical tone analysis processing, analyzed data (trajectory data) on frequency components (that is, the fundamental tone and its overtones) which are the harmonics of a target pitch, separation waveform data DW corresponding to a specified constituent note is generated.

The separation of separation waveform data DW from reference waveform data OW is not limited to the above-described method, but may be done by any method as long as components of a specified chord constituent note and its overtones can be separated from reference waveform data OW.

In this embodiment, a set of separation waveform data DW corresponding to a constituent note is generated on the basis of reference waveform data OW in accordance with separation patterns of five stages to store the generated separation waveform data DW for later use. The separation pattern of the zeroth stage has only the original reference waveform data OW for which separation processing has not been performed. The data on this stage is referred to as separation pattern data DP0.

By separating components of the fourth constituent note (in this example, a major seventh) and its overtones from the reference waveform data OW of the separation pattern data DP0 of the zeroth stage, separation waveform data DWa having components of constituent notes of the chord root, a third and a fifth (in this example, intervals of a zeroth, a major third and a perfect fifth) and their overtones, and separation waveform data DWb having components only of the fourth constituent note (in this example, the major seventh) and its overtones are generated. The generated separation waveform data DWa and separation waveform data DWb are stored as separation pattern data DP1 of the first stage.

By separating components of the constituent note having the interval of the third (in this example, the major third) and its harmonics from the separation waveform data DWa of the separation pattern data DP1 of the first stage, separation waveform data DWc having components of the constituent notes of the chord root and the fifth (in this example, the zeroth and the perfect fifth) and their overtones, and separation waveform data DWd having components only of the constituent note of the third (in this example, the major third) and its overtones are generated. The generated separation waveform data DWc and separation waveform data DWd, and the previously separated separation waveform data DWb corresponding to the constituent note of the seventh are stored as separation pattern data DP2 of the second stage.

From the separation waveform data DWa of the separation pattern data DP1 of the first stage, furthermore, components of the constituent note of the fifth (in this example, the perfect fifth) and its overtones can be separated. On the basis of the separation waveform data DWa, in this case, separation waveform data DWe having components of the constituent notes of the chord root and the third (in this case, the zeroth and the major third) and their overtones, and separation waveform data DWf having components only of the constituent note of the fifth (in this case, the perfect fifth) and its overtones are generated. The generated separation waveform data DWe and separation waveform data DWf, and the previously separated separation waveform data DWb corresponding to the constituent note of the seventh are stored as separation pattern data DP3 of the third stage.

By separating components of the constituent note of the fifth (in this example, the perfect fifth) and its overtones from the separation waveform data DWc of the separation pattern data DP2 of the second stage, furthermore, separation waveform data DWg having components of the chord root (zeroth) and its overtones and separation waveform data DWf having components only of the constituent note of the fifth (in this example, the perfect fifth) and its overtones are generated. The generated separation waveform data DWg and separation waveform data DWf, and the previously separated separation waveform data DWb corresponding to the constituent note of the seventh and separation waveform data DWd corresponding to the constituent note of the third are stored as separation pattern data DP4 of the fourth stage.

The separation pattern data DP4 of the fourth stage can be also derived from the separation pattern data DP3 of the third stage. From the separation waveform data DWe, in this case, the separation waveform data DWg having the components of the chord root (zeroth) and its overtones and the separation waveform data DWd having the components only of the constituent note of the third (in this case, the major third) and its overtones are generated. The generated separation waveform data DWg and separation waveform data DWd, and the previously separated separation waveform data DWb corresponding to the constituent note of the seventh and separation waveform data DWf corresponding to the constituent note of the fifth are stored as the separation pattern data DP4 of the fourth stage.

It is difficult to use the separation pattern data DP0 for chord types other than the chord type on which the original reference waveform data OW is based, for any chord constituent notes are not separated in the separation pattern data DP0. In a case where a tension note is further added, the separation pattern data DP0 is usable by combining the separation pattern data DP0 with phrase waveform data having the tension note.

The separation pattern data DP1 has the separation waveform data DWa having the components of the constituent notes of the chord root, the third and the fifth (in this example, the zeroth, the major third and the perfect fifth) and their overtones and the separation waveform data DWb having the components of the constituent note of the seventh and its overtones. By pitch-shifting the separation waveform data DWb and then combining the pitch-shifted separation waveform data DWb with the separation waveform data DWa, or by directly combining the separation waveform data DWb with the separation waveform data DWa without pitch-shifting, the combined data is applicable to the chord types (6, M7, 7). Furthermore, the separation waveform data DWa can be used individually as the data based on the chord type (Maj).

The separation pattern data DP2 has the separation waveform data DWc having the components of the constituent notes of the chord root and the fifth (in this example, the zeroth and the perfect fifth) and their overtones, the separation waveform data DWd having the components of the constituent note of the third and its overtones and the separation waveform data DWb having the components of the constituent note of the seventh and its overtones. By pitch-shifting the separation waveform data DWd and then combining the pitch-shifted separation waveform data DWd with the separation waveform data DWc, or by directly combining the separation waveform data DWd with the separation waveform data DWc without pitch-shifting, therefore, the combined data is applicable to the chord types (maj, m, sus4). By pitch-shifting the separation waveform data DWb and then combining the pitch-shifted separation waveform data DWb with the above-combined separation waveform data, or by directly combining the separation waveform data DWb with the above-combined separation waveform data, the combined data is applicable to the chord types (6, M7, 7, m6, m7, mM7, 7sus4). Furthermore, the separation waveform data DWc can be used individually as the data based on the chord type (1+5).

The separation pattern data DP3 has the separation waveform data DWe having the components of the constituent notes of the chord root and the third (in this example, the zeroth and the major third) and their overtones, the separation waveform data DWf having the components of the constituent note of the fifth and its overtones and the separation waveform data DWb having the components of the constituent note of the seventh and its overtones. By pitch-shifting the separation waveform data DWf and then combining the pitch-shifted separation waveform data DWf with the separation waveform data DWe, or by directly combining the separation waveform data DWf with the separation waveform data DWe without pitch-shifting, therefore, the combined data is applicable to the chord types (maj, aug, ♭5). By pitch-shifting the separation waveform data DWb and then combining the pitch-shifted separation waveform data DWb with the above-combined separation waveform data, or by directly combining the separation waveform data DWb with the above-combined separation waveform data, furthermore, the combined data is applicable to the chord types (6, M7, M7(♭5), 7(♭5), 7aug, M7aug).

The separation pattern data DP4 has the sets of separation waveform data DWg, DWd, DWf and DWb each having the components of different one of the constituent notes of the chord type and its overtones. By combining the separation waveform data DW which has been pitch-shifted or has not been pitch-shifted with different separation waveform data DW, therefore, the combined data is applicable to the chord types indicated in FIG. 5.

The combining of the separation waveform data DW and the pitch-shifting of the separation waveform data DW are done by conventional arts. For instance, the arts described in the above-described DESCRIPTION OF THE PREFERRED EMBODIMENT of Japanese Unexamined Patent Publication No. 2004-21027 can be used. What is described in the Japanese Unexamined Patent Publication No. 2004-21027 is incorporated in this specification of the present invention.

In this specification, furthermore, when simply denoted as the separation waveform data DW, it represents any one of or all of the separation waveform data sets DWa to DWg. In addition, waveform data in which an accompaniment phrase such as the separation waveform data DW and the reference waveform data OW are stored is referred to as phrase waveform data.

FIG. 5 is a conceptual diagram indicative of an example chord type-organized semitone distance table according to the embodiment of the present invention.

In this embodiment, reference waveform data OW or separation waveform data DW having a chord root is pitch-shifted in accordance with a chord root indicated by chord information input by user's musical performance or the like, while separation waveform data DW having one or more constituent notes is also pitch-shifted in accordance with the chord root and the chord type to combine the pitch-shifted waveform data to generate combined waveform data suitable for accompaniment phrase based on the chord type and the chord root indicated by the input chord information.

In a case where separation waveform data is separated from reference waveform data OW based on CM7 so that each set of separation waveform data DW will have a different note as in the case of the separation pattern data DP4 indicated in FIG. 4, for example, the sets of separation waveform data DW are provided only for a major third (distance of 4 semitones), a perfect fifth (distance of 7 semitones) and a major seventh (distance of 11 semitones). For constituent notes other than the above notes, therefore, it is necessary to pitch-shift separation waveform data DW in accordance with a chord type. Therefore, when one or more sets of separation waveform data DW need to be pitch-shifted in accordance with a chord root and a chord type, the chord type-organized semitone distance table indicated in FIG. 5 is referred to.

The chord type-organized semitone distance table is a table which stores each distance indicated by semitones from chord root to chord root, a third, a fifth and the fourth note of a chord of each chord type. In a case of a major chord (Maj), for example, respective distances of semitones from a chord root to the chord root, a third and a fifth of the chord are "0", "4", and "7", respectively. In this case, pitch-shifting according to chord type is not necessary, for separation waveform data DW of this embodiment is provided for the major third (distance of 4 semitones) and the perfect fifth (distance of 7 semitones). However, the chord type-organized semitone distance table indicates that in a case of minor seventh (m7), because respective distances of semitones from a chord root to the chord root, a third, a fifth and a seventh are "0", "3", "7", and "10", respectively, it is necessary to lower respective pitches of separation waveform data sets DW for the major third (distance of 4 semitones) and the major seventh (distance of 11 semitones) by one semitone.

In a case where separation waveform data DW for tension chord tone is used, it is necessary to add respective distances of semitones from chord root to ninth, eleventh and thirteenth intervals to the chord type-organized semitone distance table.

Figure 6A:
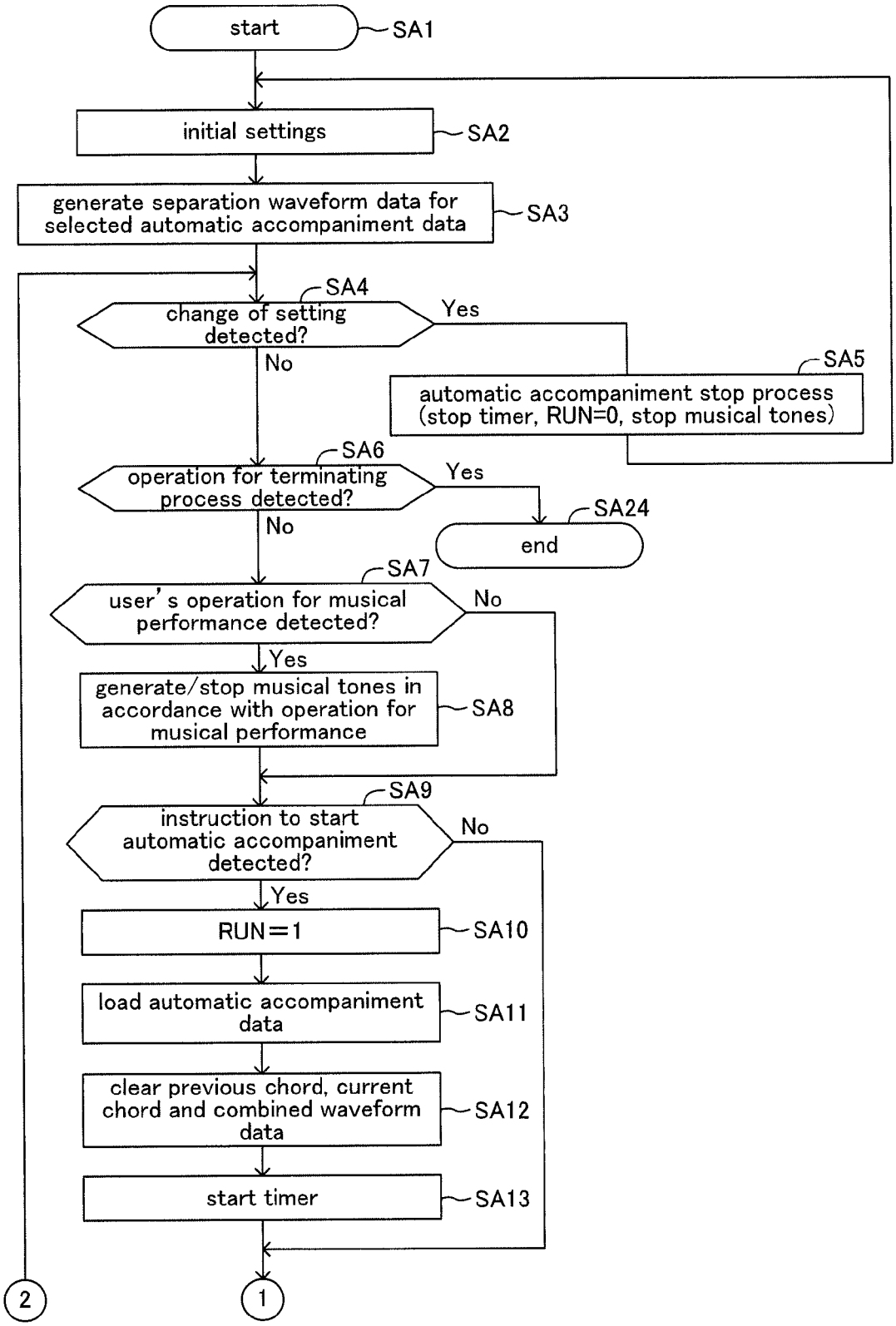
FIG. 6A is the first half of a flowchart of a main process according to the embodiment of the present invention.
Figure 6B:
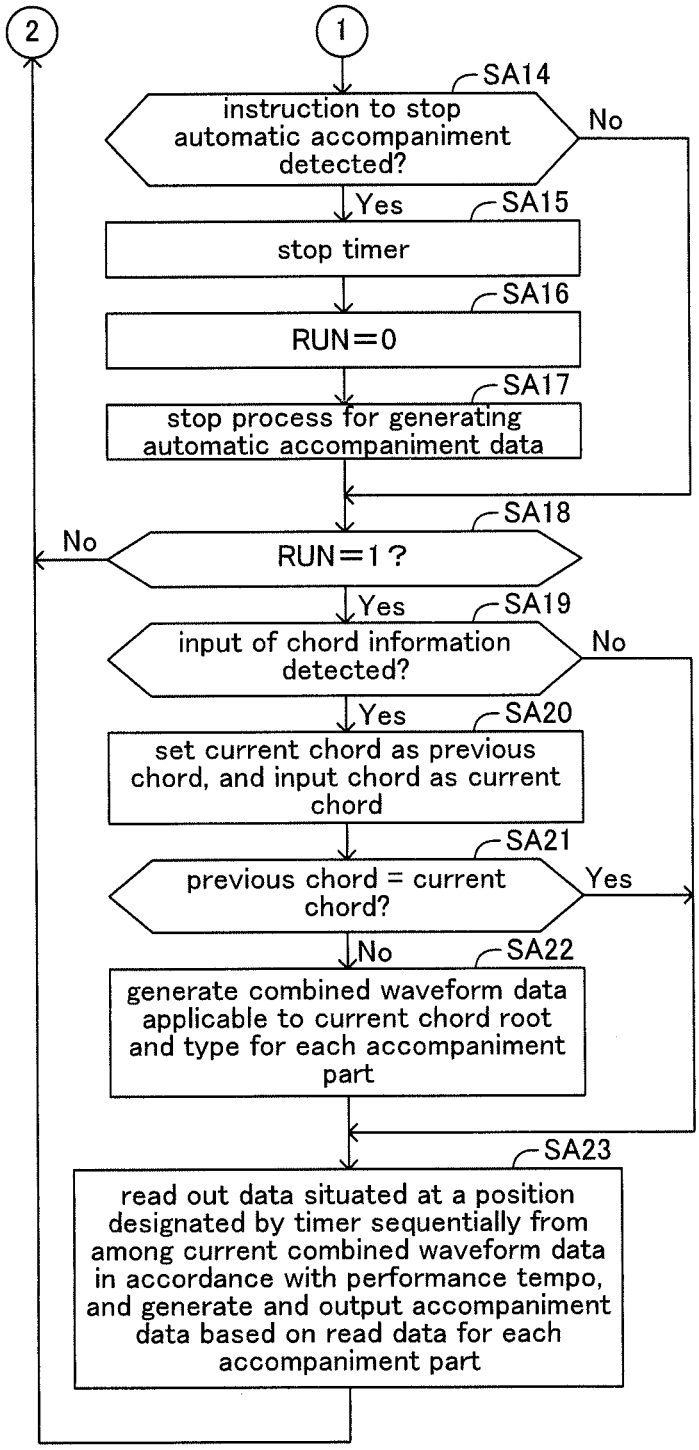
FIG. 6B is the latter half of the flowchart of the main process.

FIG. 6A and FIG. 6B are a flowchart of a main process of the embodiment of the present invention. This main process starts when power of the accompaniment data generating apparatus 100 according to the embodiment of the present invention is turned on.

At step SA1 of FIG. 6, the main process starts. At step SA2, initial settings are made. The initial settings include selection of automatic accompaniment data AA, designation of a chord type which will be used (e.g., using only primary triads, triads, seventh chords), designation of method of retrieving chord (input by user's musical performance, input by user's direct designation, automatic input based on chord progression information or the like), designation of performance tempo, and designation of key. The initial settings are made by use of the setting operating elements 12, for example, shown in FIG. 1. Furthermore, an automatic accompaniment process start flag RUN is initialized (RUN=0), and a timer, the other flags and registers are also initialized.

Step SA3 performs the separation processing for reference waveform data OW included in accompaniment pattern data AP of each part included in the automatic accompaniment data AA selected at step SA2 or step SA4 which will be explained later. The separation processing is done as explained with reference to FIG. 4. The degree of separation in the separation processing (which one of the separation patterns DP0 to DP4 will be generated by the separation processing) is determined according to default settings or the chord type designated by the user at step SA2. In a case, for example, where the user has specified at step SA2 that only primary triads will be used, the separation pattern DP1 indicated in FIG. 4 is to be generated, because the separation pattern DP1 will be adequate. In a case where the user has specified that basic chords including seventh chords will be used, the separation pattern DP2 indicated in FIG. 4 is to be generated, because the separation pattern DP2 will be adequate. In a case where the user has specified that chords which are widely used in general music will be used, the separation pattern DP4 indicated in FIG. 4 is to be generated. The generated separation waveform data DW is correlated with the accompaniment pattern data AP along with the original reference waveform data OW to be stored in the storage device 15, for example. In a case where separation pattern data DP which should be generated for the selected automatic accompaniment data AA has been already generated and stored, the stored separation waveform data DW can be used. In such a case, therefore, the separation processing at step SA3 will be omitted. At each input of chord information, furthermore, the separation processing may be performed in accordance with the input chord information so that the generated separation waveform data will be stored.

At step SA4, it is determined whether user's operation for changing a setting has been detected or not. The operation for changing a setting indicates a change in a setting which requires initialization of current settings such as re-selection of automatic accompaniment data AA. Therefore, the operation for changing a setting does not include a change in performance tempo, for example. When the operation for changing a setting has been detected, the process proceeds to step SA5 indicated by a "YES" arrow. When any operation for changing a setting has not been detected, the process proceeds to step SA6 indicated by a "NO" arrow.

At step SA5, an automatic accompaniment stop process is performed. The automatic accompaniment stop process stops the timer and sets the flag RUN at 0 (RUN=0), for example, to perform the process for stopping musical tones currently generated by automatic accompaniment. Then, the process returns to SA2 to make initial settings again in accordance with the detected operation for changing the setting. In a case where any automatic accompaniment is not being performed, the process directly returns to step SA2.

At step SA6, it is determined whether or not operation for terminating the main process (the power-down of the accompaniment data generating apparatus 100) has been detected. When the operation for terminating the process has been detected, the process proceeds to step SA24 indicated by a "YES" arrow to terminate the main process. When the operation for terminating the process has not been detected, the process proceeds to step SA7 indicated by a "NO" arrow.

At step SA7, it is determined whether or not user's operation for musical performance has been detected. The detection of user's operation for musical performance is done by detecting whether any musical performance signals have been input by operation of the performance operating elements 22 shown in FIG. 1 or any musical performance signals have been input via the communication I/F 21. In a case where operation for musical performance has been detected, the process proceeds to step SA8 indicated by a "YES" arrow to perform a process for generating musical tones or a process for stopping musical tones in accordance with the detected operation for musical performance to proceed to step SA9. In a case where any musical performance operations have not been detected, the process proceeds to step SA9 indicated by a "NO" arrow.

At step SA9, it is determined whether or not an instruction to start automatic accompaniment has been detected. The instruction to start automatic accompaniment is made by user's operation of the setting operating element 12, for example, shown in FIG. 1. In a case where the instruction to start automatic accompaniment has been detected, the process proceeds to step SA10 indicated by a "YES" arrow. In a case where the instruction to start automatic accompaniment has not been detected, the process proceeds to step SA14 of FIG. 6B indicated by a "NO" arrow.

At step SA10, the flag RUN is set at 1 (RUN=1). At step SA11, automatic accompaniment data AA selected at step SA2 or step SA4 is loaded from the storage device 15 or the like shown in FIG. 1 to an area of the RAM 7, for example. Then, at step SA12, the previous chord, the current chord and combined waveform data are cleared. At step SA13, the timer is started to proceed to step SA14 of FIG. 6B.

At step SA14 of FIG. 6B, it is determined whether or not an instruction to stop the automatic accompaniment has been detected. The instruction to stop automatic accompaniment is made by user's operation of the setting operating elements 12 shown in FIG. 1, for example. In a case where an instruction to stop the automatic accompaniment has been detected, the process proceeds to step SA15 indicated by a "YES" arrow. In a case where an instruction to stop the automatic accompaniment has not been detected, the process proceeds to step SA18 indicated by a "NO" arrow.

At step SA15, the timer is stopped. At step SA16, the flag RUN is set at 0 (RUN=0). At step SA17, the process for generating automatic accompaniment data is stopped to proceed to step SA18.

At step SA18, it is determined whether the flag RUN is set at 1. In a case where the RUN is 1 (RUN=1), the process proceeds to step SA19 indicated by a "YES" arrow. In a case where the RUN is 0 (RUN=0), the process returns to step SA4 of FIG. 6A indicated by a "NO" arrow.

At step SA19, it is determined whether input of chord information has been detected (whether chord information has been retrieved). In a case where input of chord information has been detected, the process proceeds to step SA20 indicated by a "YES" arrow. In a case where input of chord information has not been detected, the process proceeds to step SA23 indicated by a "NO" arrow.

The cases where input of chord information has not been detected include a case where automatic accompaniment is currently being generated on the basis of any chord information and a case where there is no valid chord information. In the case where there is no valid chord information, accompaniment data having only a rhythm part, for example, which does not require any chord information may be generated. Alternatively, step SA19 may be repeated to wait for generation of accompaniment data without proceeding to step SA23 until valid chord information is input.

The input of chord information is done by user's musical performance using the musical performance operating elements 22 indicated in FIG. 1 or the like. The retrieval of chord information based on user's musical performance may be detected from a combined key-depressions made in a chord key range which is a range included in the musical performance operating elements 22 of the keyboard or the like, for example (in this case, any musical notes will not be emitted in response to the key-depressions). Alternatively, the detection of chord information may be done on the basis of depressions of keys detected on the entire keyboard within a predetermined timing period. Furthermore, known chord detection arts may be employed. Furthermore, the input of chord information may not be limited to the musical performance operating elements 22 but may be done by the setting operating elements 12. In this case, chord information can be input as a combination of information (letter or numeric) indicative of a chord root and information (letter or numeric) indicative of a chord type. Alternatively, information indicative of an applicable chord may be input by use of a symbol or number (see a table indicated in FIG. 3, for example). Furthermore, chord information may not be input by a user, but may be obtained by reading out a previously stored chord sequence (chord progression information) at a predetermined tempo, or by detecting chords from currently reproduced song data or the like.

At step SA20, the chord information specified as "current chord" is set as "previous chord", whereas the chord information detected (obtained) at step SA19 is set as "current chord".

At step SA21, it is determined whether the chord information set as "current chord" is the same as the chord information set as "previous chord". In a case where the two pieces of chord information are the same, the process proceeds to step SA23 indicated by a "YES" arrow. In a case where the two pieces of chord information are not the same, the process proceeds to step SA22 indicated by a "NO" arrow. At the first detection of chord information, the process proceeds to step SA22.

At step SA22, combined waveform data applicable to the chord type (hereafter referred to as current chord type) and the chord root (hereafter referred to as current chord root) indicated by the chord information set as the "current chord" is generated for each accompaniment part (track) included in the automatic accompaniment data AA loaded at step SA11 to define the generated combined waveform data as the "current combined waveform data". The generation of combined waveform data will be described later with reference to FIG. 7A and FIG. 7B.

At step SA23, data situated at a position designated by the timer is sequentially read out from among the "current combined waveform data" defined at step SA22 in accordance with a specified performance tempo for each accompaniment part (track) of the automatic accompaniment data AA loaded at step SA11 so that accompaniment data will be generated to be output on the basis of the read data. Then, the process returns to step SA4 of FIG. 6A to repeat later steps.

Furthermore, this embodiment is designed such that the automatic accompaniment data AA is selected by a user at step SA2 before the start of automatic accompaniment or at steps SA4 during automatic accompaniment. In a case where previously stored chord sequence data or the like is reproduced, however, the chord sequence data or the like may include information for designating automatic accompaniment data AA to read out the information to automatically select automatic accompaniment data AA. Alternatively, automatic accompaniment data AA may be previously selected as default.

Furthermore, the instruction to start or stop reproduction of selected automatic accompaniment data AA is done by detecting user's operation at step SA9 or step SA14. However, the start and stop of reproduction of selected automatic accompaniment data AA may be automatically done by detecting start and stop of user's musical performance using the performance operating elements 22.

Furthermore, the automatic accompaniment may be immediately stopped in response to the detection of the instruction to stop automatic accompaniment at step SA14. However, the automatic accompaniment may be continued until the end or a break (a point at which notes are discontinued) of the currently reproduced phrase waveform data PW, and then be stopped.

Figure 7A:
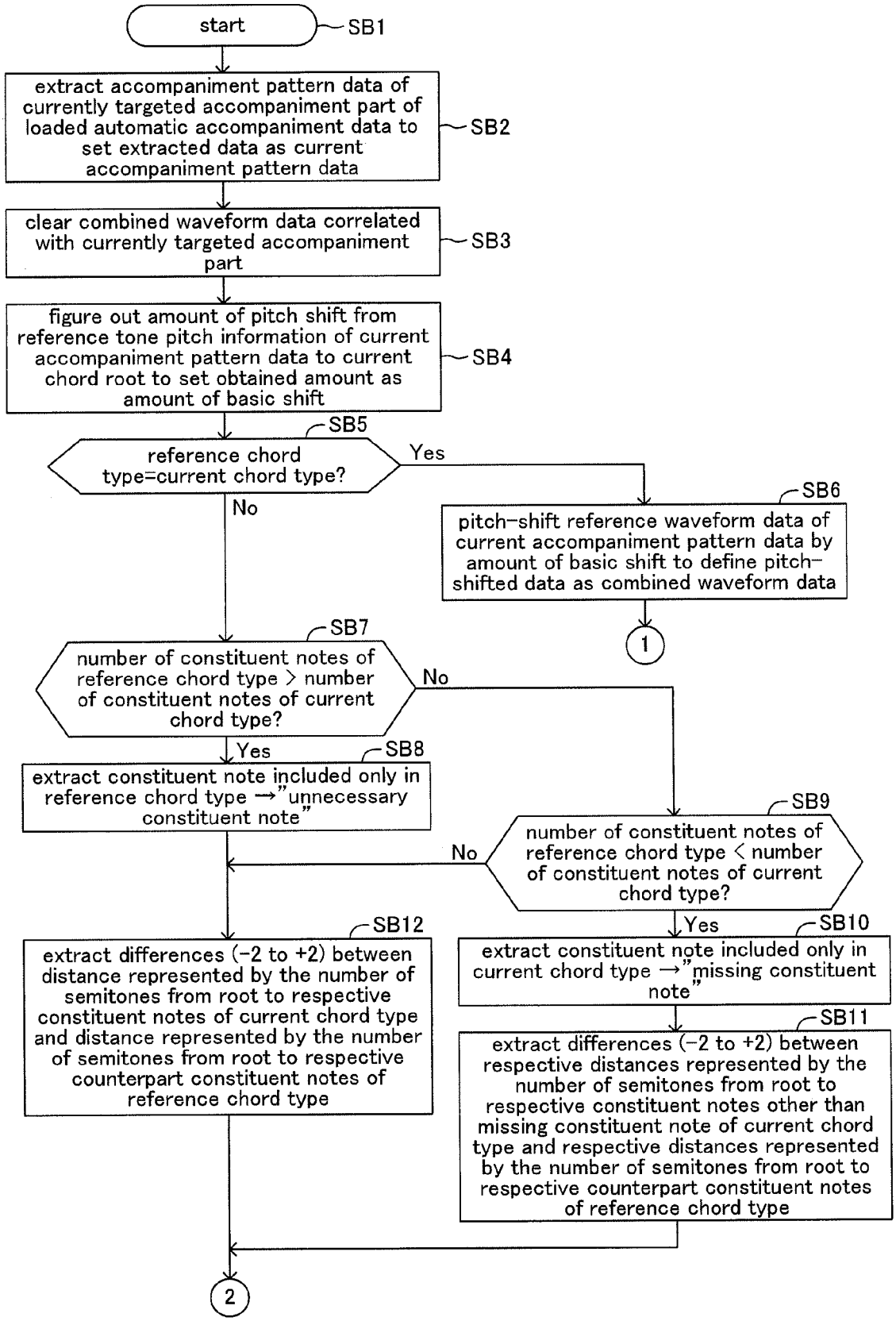
FIG. 7A is the first half of a flowchart of a combined waveform data generating process performed at step SA22 of FIG. 6B.
Figure 7B:
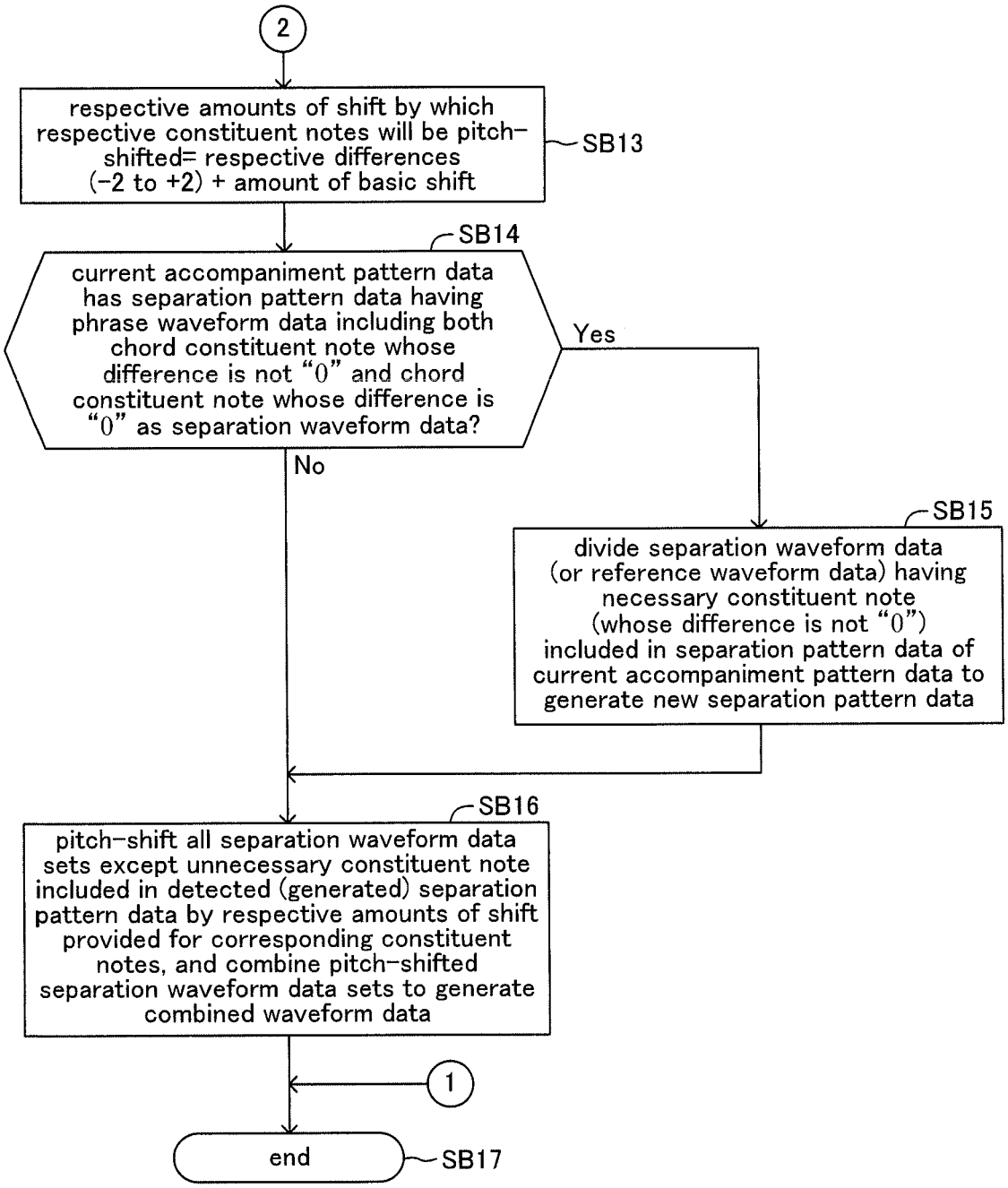
FIG. 7B is the latter half of the flowchart of the combined waveform data generating process.

FIG. 7A and FIG. 7B indicate a flowchart indicative of the combined waveform data generation process which will be executed at step SA22 of FIG. 6B. In a case where the automatic accompaniment data AA includes a plurality of accompaniment parts, the process will be repeated for the number of accompaniment parts. Furthermore, explanation will be made, assuming that the separation pattern data DP4 indicated in FIG. 4 is generated at step SA3 of FIG. 6A.

At step SB1 of FIG. 7A, the combined waveform data generation process starts. At step SB2, the accompaniment pattern data AP correlated with the currently targeted accompaniment part of the automatic accompaniment data AA loaded at step SA11 of FIG. 6 is extracted to be set as the "current accompaniment pattern data".

At step SB3, combined waveform data correlated with the currently targeted accompaniment part is cleared.

At step SB4, an amount of pitch shift is figured out in accordance with a difference (distance represented by the number of semitones) between the reference tone pitch information (chord root information) of the accompaniment pattern data AP set as the "current accompaniment pattern data" and the chord root of the chord information set as the "current chord" to set the obtained amount of pitch shift as "amount of basic shift". There can be a case where the amount of basic shift is negative. In this embodiment, the chord root of the accompaniment pattern data AP is "C", while the chord root of the chord information is "D" in a case where the input chord information is "Dm7". Therefore, the "amount of basic shift" is "2 (distance represented by the number of semitones)".

At step SB5, it is judged whether or not the reference chord type (the chord type on which the reference waveform data OW of the current accompaniment pattern data AP is based) is the same as the current chord type (reference chord type=current chord type). In a case where they are the same, individual pitch-shifting for the respective constituent notes is not necessary. Therefore, the process proceeds to step SB6 indicated by a "Yes" arrow to pitch-shift the reference waveform data OW of the current accompaniment pattern data AP by the "amount of basic shift" set at step SB4 to define the pitch-shifted data as combined waveform data to proceed to step SB17 to terminate the combined waveform data generation process to proceed to step SA23 of FIG. 6. In a case where they are not the same, individual pitch-shifting for the respective constituent notes is necessary. Therefore, the process proceeds to step SB7 indicated by a "No" arrow.

At step SB7, it is judged whether or not the number of constituent notes of the reference chord type is greater than the number of constituent notes of the current chord type (the number of constituent notes of the reference chord type>the number of constituent notes of the current chord type). In a case where the number of constituent notes of the reference chord type is greater than the number of constituent notes of the current chord type, the process proceeds to step SB8 indicated by a "Yes" arrow to extract a constituent note which is included only in the reference chord type and is not included in the current chord type and to define the extracted constituent note as "unnecessary constituent note" to proceed to step SB12. In a case where the number of constituent notes of the reference chord type is the same as or smaller than the number of constituent notes of the current chord type, the process proceeds to step SB9 indicated by a "No" arrow. Suppose that the current chord type is Dm, for example. Because the reference chord type of this embodiment is CM7, the constituent note having the interval of the seventh is included only in the reference chord type and is defined as the "unnecessary constituent note".

At step SB9, it is judged whether the number of constituent notes of the reference chord type is smaller than the number of constituent notes of the current chord type (the number of constituent notes of the reference chord type<the number of constituent notes of the current chord type). In a case where the number of constituent notes of the reference chord type is smaller than the number of constituent notes of the current chord type, the process proceeds to step SB10 indicated by a "Yes" arrow. In a case where the number of constituent notes of the reference chord type is the same as the number of constituent notes of the current chord type, the process proceeds to step SB12 indicated by a "No" arrow.

At step SB10, a constituent note which is included only in the current chord type and is not included in the reference chord type is extracted as a "missing constituent note". Suppose that the current chord type is Dm7 (9), for example. Because the reference chord type of this embodiment is CM7, the constituent note having the interval of the ninth is included only in the current chord type and is defined as the "missing constituent note".

At step SB11, the differences (−2 to +2) between respective distances represented by the number of semitones from the chord root to the respective constituent notes other than the missing constituent note of the current chord type and respective distances represented by the number of semitones from the chord root to the respective counterpart constituent notes of the reference chord type are extracted with reference to the chord type-organized semitone distance table indicated in FIG. 5 to proceed to step SB13 of FIG. 7B. In this specification, a constituent note of the current chord type and a counterpart constituent note of the reference chord type indicate the notes having the same interval above their respective chord roots. As exceptions, however, a fourth of sus4 is treated as a constituent note having the interval of a third. In addition, a sixth of a sixth chord is treated as a constituent note of the fourth note. Although it is preferable that these correspondences are previously defined, the correspondences may be specified by the user. In a case where the current chord type is Dm7 (9), for example, because the reference chord type is CM7 in this embodiment, respective differences between the current chord type and the reference chord type are figured out for the constituent notes other than the constituent note having the interval of a ninth which is the "missing constituent note". More specifically, the chord type-organized semitone distance table indicated in FIG. 5 reveals that respective distances represented by the number of semitones between the chord root and the respective constituent notes except the constituent note of the ninth which is the "missing constituent note" of the current chord type Dm7(9) are "0" for the root, "3" for the third, "7" for the fifth, "10" for the fourth note. The chord type-organized semitone distance table indicated in FIG. 5 also reveals that respective distances represented by the number of semitones between the chord root and the respective constituent notes of the reference chord type CM7 are "0" for the root, "4" for the third, "7" for the fifth, "11" for the fourth note. Therefore, the obtained differences between the constituent notes of the current chord type and the counterparts of the reference chord type are "0" for the root, "−1" for the third, "0" for the fifth and "−1" for the fourth note.

At step SB12, the differences (−2 to +2) between respective distances represented by the number of semitones from the chord root to the respective constituent notes of the current chord type and respective distances represented by the number of semitones from the chord root to the respective counterpart constituent notes of the reference chord type are extracted with reference to the chord type-organized semitone distance table indicated in FIG. 5 to proceed to step SB13. Because the differences of the constituent notes of the current chord type with respect to the counterpart constituent notes of the reference chord type will be extracted, the "unnecessary constituent note" will be ignored. In a case where the current chord type is Dm, for example, because the reference chord type of this embodiment is CM7, differences will be figured out for the respective constituent notes except the note of the seventh which is the "unnecessary constituent note". The chord type-organized semitone distance table indicated in FIG. 5 reveals that respective distances represented by the number of semitones between the chord root and the respective constituent notes of the current chord type Dm are "0" for the root, "3" for the third, and "7" for the fifth. The chord type-organized semitone distance table indicated in FIG. 5 also reveals that respective distances represented by the number of semitones between the chord root and the respective constituent notes of the reference chord type CM7 are "0" for the root, "4" for the third, and "7" for the fifth. Therefore, the obtained differences between the constituent notes of the current chord type and the counterparts of the reference chord type are "0" for the root, "−1" for the third, and "0" for the fifth.

At step SB13 of FIG. 7B, respective amounts of shift are figured out for respective constituent notes of the reference chord type in accordance with the differences extracted at step SB11 or step SB12. The respective amounts of shift for the constituent notes are obtained by adding the amount of basic shift to the respective differences extracted at step SB11 or step SB12. In a case where the current chord type is Dm7 (9), for example, respective amounts of shift by which the constituent notes of the reference chord type should be pitch-shifted are obtained in accordance with the differences extracted at step SB11 as follows: "0+2=2" for the chord root, "−1+2=1" for the third, "0+2=2" for the fifth, and "−1+2=1" for the fourth note. In a case where the current chord type is Dm, respective amount of shift are: "0+2=2" for the chord root, "−1+2=1" for the third, and "0+2=2" for the fifth.

At step SB14, it is judged whether in a case where the separation pattern data DP correlated with the current accompaniment pattern data AP has a set of phrase waveform data having a plurality of chord constituent notes (including unnecessary constituent note) as a set of separation waveform data DW, the set of phrase waveform data has both a chord constituent note (excluding missing constituent note) whose difference is "0" and a chord constituent note (including unnecessary constituent note) whose difference is not "0". As described above, the difference is a difference between the distance represented by the number of semitones from the chord root to a constituent note of the current chord type and the distance represented by the number of semitones from the chord root to a counterpart constituent note of the reference chord type. At the above-described step SB14, in other words, it is judged whether or not the separation pattern data DP has a set of separation waveform data DW which has both a chord constituent note (excluding missing constituent note) specified by the current chord type and a chord constituent note which is not specified by the current chord type. In a case where any separation waveform data DW having a plurality of chord constituent notes does not exist in the separation pattern data DP, it is judged that the current accompaniment pattern data AP does not have any such separation pattern data DP having such separation waveform data DW. In a case where the current accompaniment pattern data AP does not have any separation pattern data DP having such separation waveform data DW, the process proceeds to step SB16 indicated by a "No" arrow. In a case where the current accompaniment pattern data AP has such separation pattern data DP, the process proceeds to step SB15 indicated by a "Yes" arrow. In a case where a set of separation waveform data DW has a plurality of constituent notes but not both a chord constituent note whose difference is "0" and a constituent note whose difference is not "0", but the set of separation waveform data DW has a plurality of constituent notes whose amount of shift is identical, the process proceeds to step SB16 indicated by a "No" arrow, for such separation waveform data DW having the same amount of shift will not present any problem on the pitch-shifting performed at step SB16.

In a case, for example, where the separation pattern data DP4 indicated in FIG. 4 is provided at step SA3 of FIG. 6 with the current chord type being Dm7(9), the constituent notes of the current chord type are the chord root, the third, the fifth, the seventh and the ninth, but the ninth is a missing constituent note which will be ignored. The separation pattern data DP4 has the separation waveform data sets DWg, DWd, DWf and DWb corresponding to the chord root, the third, the fifth and the seventh, respectively. In this case, therefore, the process proceeds to step SB16 indicated by a "No" arrow.

In a case where the separation pattern data DP3 indicated in FIG. 4 is provided at step SA3 of FIG. 6 with the current chord type being Dm7(9), the constituent notes of the current chord type are the chord root, the third, the fifth, the seventh and the ninth, but the ninth is a missing constituent note which will be ignored. The separation pattern data DP3 has the separation waveform data sets DWf and DWb corresponding to the fifth and the seventh, respectively. As for the separation waveform data DWe corresponding to the chord root and the third, however, the amount of shift for the third is different. More specifically, the separation waveform data DWe has a chord constituent note whose difference is not "0". Therefore, the process proceeds to step SB15 indicated by a "Yes" arrow.

In a case where the separation pattern data DP2 indicated in FIG. 4 is provided at step SA3 of FIG. 6 with the current chord type being Dm7(9), the constituent notes of the current chord type are the chord root, the third, the fifth, the seventh and the ninth, but the ninth is a missing constituent note which will be ignored. The separation pattern data DP2 has the separation waveform data sets DWd and DWb corresponding to the third and the seventh, respectively. As for the separation waveform data DWc corresponding to the chord root and the fifth, furthermore, the respective amounts of shift for the chord root and the fifth are the same. More specifically, the separation waveform data DWc does not have any chord constituent note whose difference is not "0". Therefore, the process proceeds to step SB16 indicated by the "No" arrow.

At step SB15, from the separation waveform data DW (or the reference waveform data OW) included in the separation pattern data DP correlated with the current accompaniment pattern data AP, a constituent note (except missing constituent note) whose difference between the counterpart constituent note of the current chord type is not "0" and an unnecessary constituent note which have not been separated as separation waveform data DW yet is separated to generate new separation waveform data corresponding to the separated constituent note. In other words, if a set of separation waveform data DW (or reference waveform data OW) has a chord constituent note which is not specified by the chord type of the current chord, the set of separation waveform data DW is divided into a set of phrase waveform data having a chord constituent note (except missing constituent note) specified by the chord type of the current chord, a set of phrase waveform data having the chord constituent note which is not specified by the chord type and a set of phrase waveform data having an unnecessary constituent note, so that a new set of separation waveform data is generated. In a case, for example, where the separation pattern data DP3 whose reference chord is CM7 is provided while Dm7 is input, the separation waveform data DWe of the separation pattern data DP3 is divided to generate the separation waveform data DWg and the separation waveform data DWd to newly generate the separation pattern data DP4. Then, the process proceeds to step SB16.

At step SB16, all the separation waveform data sets DW except the unnecessary constituent note included in the separation pattern data DP detected at step SB14 or generated at step SB15 are pitch-shifted by respective amounts of shift of the corresponding constituent notes, so that the pitch-shifted separated waveform data sets DW are combined to generate combined waveform data. Then, the process proceeds to step SB17 to terminate the combined waveform data generation process to proceed to step SA23 of FIG. 6.

As described above, accompaniment data based on a desired chord root and a desired chord type can be obtained by pitch-shifting reference waveform data OW having a chord root or separation waveform data DW whose difference is "0" by an "amount of basic shift", and pitch-shifting separation waveform data DW having one chord constituent note whose difference is not "0" by a distance represented by the number of semitones obtained by adding (subtracting) a value corresponding to the chord type to (from) the "amount of basic shift", and then combining the pitch-shifted waveform data DW, OW.

In the above-described flowchart, the "missing constituent note" included in the current chord type is ignored, for any separation waveform data DW cannot be provided for such a note. However, automatic performance data such as MIDI data may be provided as data corresponding to constituent notes which are defined as missing constituent notes. For constituent notes which are expected to be missing constituent notes, furthermore, phrase waveform data may be previously provided separately from reference waveform data OW so that the phrase waveform data will be pitch-shifted and combined. Instead of ignoring the "missing constituent notes", furthermore, a chord type for which there exists available separation pattern data DP and which can be an alternative to the current chord type may be defined as the current chord type.

At step SB15, furthermore, instead of newly generating separation waveform data DW having a necessary constituent note, an accompaniment phrase corresponding to the separation waveform data DW having the necessary constituent note may be provided as automatic performance data such as MIDI data. Alternatively, a chord type for which there exists available separation pattern data DP and which can be an alternative to the current chord type may be defined as the current chord type.

In a case where a set of reference waveform data OW is provided for every chord root (12 notes) as indicated in FIG. 3, the calculation of amount of basic shift at step SB4 will be omitted so that the amount of basic shift will not be added at step SB13. In a case where a set of accompaniment pattern data is provided for some (2 to 11) of the chord roots, more specifically, in a case where sets of reference waveform data OW corresponding to two or more but not all of the chord roots (12 notes) are provided, a set of reference waveform data OW corresponding to the chord root having the smallest difference in tone pitch between the chord information (chord root) set as the "current chord" may be read out to define the difference in tone pitch as "amount of basic shift". In this case, a set of reference waveform data OW corresponding to the chord root having the smallest difference in tone pitch between the chord information (chord root) set as the "current chord" is selected to provide the separation pattern data DP1 to DP4 (separation waveform data DW) at step SA3 or step SB2.

In a case where a set of reference waveform data OW based on CM7 and a set of reference waveform data OW based on Dm7 (or Em7, Am7 or the like) are provided, only the constituent note of a seventh may be separated without separating constituent notes of a third and a fifth (the separation pattern data DP1 of FIG. 4). In this case, the separation waveform data DW separated from CM7 will be pitch-shifted for major chords, while the separation waveform data DW separated from Dm7 will be pitch-shifted for minor chords. By providing the two sets of reference waveform data OW based on a major chord and a minor chord, as described above, the separation pattern data DP1 of FIG. 4 is applicable to various chord types.

According to the embodiment of the present invention, as described above, the reference waveform data OW which is correlated with accompaniment pattern data AP, is based on a chord of a chord root and a chord type, and has a plurality of constituent notes of the chord is provided. As necessary, furthermore, the reference waveform data OW or the separation waveform data having the constituent notes is separated to generate separation waveform data DW having the constituent note whose difference value is not "0". By pitch-shifting appropriate separation waveform data DW and combining appropriate sets of separation waveform data, furthermore, combined waveform data which is applicable to a desired chord type can be generated. Therefore, the embodiment of the present invention enables automatic accompaniment suitable for various input chords.

In the embodiment of the present invention, furthermore, phrase waveform data having a constituent note whose difference value is not "0" can be derived as separation waveform data DW from reference waveform data OW or separation waveform data DW having a plurality of notes to pitch-shift the derived separation waveform data DW to combine the pitch-shifted data. Therefore, even if a chord of a chord type which is different from a chord type on which a set of reference waveform data OW is based is input, the reference waveform data OW is applicable to the input chord. Furthermore, the embodiment of the present invention can manage changes in chord type brought about by chord changes.

In a case, furthermore, where reference waveform data OW is provided for every chord root, one of the reference waveform data sets OW can be applicable to any chord only by pitch-shifting a part of its constituent notes. Therefore, the embodiment of the present invention can minimize deterioration of sound quality caused by pitch-shifting.

Furthermore, by storing sets of separation waveform data DW which have been already separated with the sets of separation waveform data DW being associated with their respective accompaniment pattern data sets AP, a set of separation waveform data DW or a set of reference waveform data OW which is appropriate to an input chord can be read out and combined without the need for separation processing.

Furthermore, because accompaniment patterns are provided as phrase waveform data, the embodiment enables automatic accompaniment of high sound quality. In addition, the embodiment enables automatic accompaniment which uses peculiar musical instruments or peculiar scales for which a MIDI tone generator is difficult to generate musical tones.

Although the present invention has been explained in line with the above-described embodiment, the present invention is not limited to the embodiment. It is obvious for persons skilled in the art that various modifications, improvements, combinations and the like are possible. Hereafter, modified examples of the embodiment of the present invention will be described.

In the above-described embodiment, at step SB13, the amount of shift is figured out for each constituent note by adding a difference extracted at step SB11 or step SB12 to the "amount of basic shift" calculated at step SB4, while all the separation waveform data sets are pitch-shifted at step SB16 by respective amounts of shift figured out for the constituent notes. Instead of this manner, however, combined waveform data may be eventually pitch-shifted by the "amount of basic shift" as follows. More specifically, without adding the "amount of basic shift", only the differences extracted at step SB11 or SB12 will be set as respective amounts of shift for the constituent notes at step SB13. At step SB16, all the separation waveform data sets will be pitch-shifted only by the respective amounts of shift set at step SB13 to combine the pitch-shifted separation waveform data sets to pitch-shift the combined waveform data by the "amount of basic shift".

In the above-described embodiment, furthermore, the separation patterns DP1 to DP4 each having sets of separation waveform data DW are derived from a set of reference waveform data OW. However, the embodiment may be modified to previously store at least one of the separation pattern data sets DP1 to DP4 having sets of separation waveform data DW. Furthermore, at least one of the separation pattern data sets DP1 to DP4 may be retrieved from an external apparatus as necessary.

In the embodiment, recording tempo of reference waveform data OW is stored as attribute information of automatic accompaniment data AA. However, recording tempo may be stored individually in each set of reference waveform data OW. In the embodiment, furthermore, reference waveform data OW is provided only for one recording tempo. However, reference waveform data OW may be provided for each of different kinds of recording tempo.

Furthermore, the embodiment of the present invention is not limited to electronic musical instrument, but may be embodied by a commercially available computer or the like on which a computer program or the like equivalent to the embodiment is installed.

In this case, the computer program or the like equivalent to the embodiment may be offered to users in a state where the computer program is stored in a computer-readable storage medium such as a CD-ROM. In a case where the computer or the like is connected to a communication network such as LAN, Internet or telephone line, the computer program, various kinds of data and the like may be offered to users via the communication network.

What is claimed is:

1. An accompaniment data generating apparatus comprising:

a storage device for storing a set of phrase waveform data having a plurality of concurrent constituent notes which form a chord;

a separating portion for separating the set of phrase waveform data having the chord constituent notes into concurrent sets of phrase waveform data formed of a set of phrase waveform data having at least one of the chord constituent notes and a set of phrase waveform data which does not have the at least one of the chord constituent notes but has different one of the chord constituent notes;

an obtaining portion for obtaining chord information which identifies chord type and chord root; and a chord note phrase generating portion for pitch-shifting one or more of the separated phrase waveform data sets in accordance with at least the chord type identified on the basis of the obtained chord information, and combining the separated phrase waveform data sets including the pitch-shifted phrase waveform data to generate, as accompaniment data, a set of waveform data indicative of a chord note phrase corresponding to the chord root and the chord type identified on the basis of the obtained chord information.

2. The accompaniment data generating apparatus according to claim 1, wherein the separating portion separates the phrase waveform data set having the chord constituent notes into a set of phrase waveform data having two or more of the chord constituent notes and a set of phrase waveform data having one chord constituent note which is included in the chord constituent notes but is different from the two or more of the chord constituent notes.

3. The accompaniment data generating apparatus according to claim 2, wherein the set of phrase waveform data which is separated by the separating portion and has the two or more chord constituent notes has chord constituent notes which are a chord root, a note having an interval of a third, and a note having an interval of a fifth, chord constituent notes which are the chord root and the note having the interval of the fifth, or chord constituent notes which are the chord root and the note having the interval of the third.

4. The accompaniment data generating apparatus according to claim 1, wherein the separating portion has a conditional separating portion for separating, if one set of phrase waveform data has both a chord constituent note defined by the chord type identified on the basis of the chord information obtained by the obtaining portion and a chord constituent note which is not defined by the chord type, the one set of phrase waveform data into a set of phrase waveform data having the chord constituent note defined by the chord type and a set of phrase waveform data having the chord constituent note which is not defined by the chord type.

5. The accompaniment data generating apparatus according to claim 1, wherein the separating portion separates the set of phrase waveform data into a plurality of phrase waveform data sets each corresponding to different one of the chord constituent notes.

6. The accompaniment data generating apparatus according to claim 1, wherein the storage device stores one set of phrase waveform data having a plurality of constituent notes of a chord; and the chord note phrase generating portion includes:

a first pitch-shifting portion for pitch-shifting one or more of the phrase waveform data sets separated by the separating portion in accordance not only with the chord type identified on the basis of the chord information obtained by the obtaining portion but also with a difference in tone pitch between a chord root included in the one set of phrase waveform data and the chord root identified on the basis of the chord information obtained by the obtaining portion;

a second pitch-shifting portion for pitch-shifting the set of phrase waveform data which has been separated by the separating portion but is different from the one or more phrase waveform data sets in accordance with the difference in tone pitch between the chord root included in the one set of phrase waveform data and the chord root identified on the basis of the chord information obtained by the obtaining portion; and a combining portion for combining the phrase waveform data pitch-shifted by the first pitch-shifting portion and the phrase waveform data pitch-shifted by the second pitch-shifted portion.

7. The accompaniment data generating apparatus according to claim 1, wherein the storage device stores one set of phrase waveform data having a plurality of constituent notes of a chord; and the chord note phrase generating portion includes:

a first pitch-shifting portion for pitch-shifting one or more of the phrase waveform data sets separated by the separating portion in accordance with the chord type identified on the basis of the chord information obtained by the obtaining portion;

a combining portion for combining the one or more of the phrase waveform data sets pitch-shifted by the first pitch-shifting portion and phrase waveform data which is included in the phrase waveform data sets separated by the separating portion but is different from the one or more of the phrase waveform data sets; and a second pitch-shifting portion for pitch-shifting the combined phrase waveform data in accordance with a difference in tone pitch between a chord root included in the one set of phrase waveform data and the chord root identified on the basis of the chord information obtained by the obtaining portion.

8. The accompaniment data generating apparatus according to claim 1, wherein the storage device stores a plurality of phrase waveform data sets each having a plurality of constituent notes of a different chord;

the accompaniment data generating apparatus further includes a selecting portion for selecting a set of phrase waveform data having a chord root having the smallest difference in tone pitch between the chord root identified on the basis of the chord information obtained by the obtaining portion from among the plurality of phrase waveform data sets;

the separating portion separates the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating portion includes:

a first pitch-shifting portion for pitch-shifting one or more of the phrase waveform data sets separated by the separating portion in accordance not only with the chord type identified on the basis of the chord information obtained by the obtaining portion but also with a difference in tone pitch between the chord root included in the selected phrase waveform data set and the chord root identified on the basis of the chord information obtained by the obtaining portion;

a second pitch-shifting portion for pitch-shifting the set of phrase waveform data which has been separated by the separating portion but is different from the one or more phrase waveform data sets in accordance with the difference in tone pitch between the chord root included in the selected phrase waveform data set and the chord root identified on the basis of the chord information obtained by the obtaining portion; and a combining portion for combining the phrase waveform data pitch-shifted by the first pitch-shifting portion and the phrase waveform data pitch-shifted by the second pitch-shifted portion.

9. The accompaniment data generating apparatus according to claim 1, wherein the storage device stores a plurality of phrase waveform data sets each having a plurality of constituent notes of a different chord;

the accompaniment data generating apparatus further includes a selecting portion for selecting a set of phrase waveform data having a chord root having the smallest difference in tone pitch between the chord root identified on the basis of the chord information obtained by the obtaining portion from among the plurality of phrase waveform data sets;

the separating portion separates the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating portion includes:

a first pitch-shifting portion for pitch-shifting one or more of the phrase waveform data sets separated by the separating portion in accordance with the chord type identified on the basis of the chord information obtained by the obtaining portion;

a combining portion for combining the one or more of the phrase waveform data sets pitch-shifted by the first pitch-shifting portion and phrase waveform data which is included in the phrase waveform data sets separated by the separating portion but is different from the one or more of the phrase waveform data sets; and a second pitch-shifting portion for pitch-shifting the combined phrase waveform data in accordance with a difference in tone pitch between the chord root included in the selected phrase waveform data set and the chord root identified on the basis of the chord information obtained by the obtaining portion.

10. The accompaniment data generating apparatus according to claim 1, wherein the storage device stores a set of phrase waveform data having a plurality of constituent notes of a chord for every chord root;

the accompaniment data generating apparatus further includes a selecting portion for selecting a set of phrase waveform data corresponding to the chord root identified on the basis of the chord information obtained by the obtaining portion from among the plurality of phrase waveform data sets;

the separating portion separates the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating portion includes:

a pitch-shifting portion for pitch-shifting one or more of the phrase waveform data sets separated by the separating portion in accordance with the chord type identified on the basis of the chord information obtained by the obtaining portion; and a combining portion for combining the one or more of the phrase waveform data sets pitch-shifted by the pitch-shifting portion and phrase waveform data which is included in the phrase waveform data sets separated by the separating portion but is different from the one or more of the phrase waveform data sets.

11. A non-transitory computer-readable medium storing an accompaniment data generation program that is executed by a computer, and is applied to an accompaniment data generating apparatus including a storage device for storing a set of phrase waveform data having a plurality of concurrent constituent notes which form a chord, the program comprising the steps of:

a separating step of separating the set of phrase waveform data having the chord constituent notes into concurrent sets of phrase waveform data formed of a set of phrase waveform data having at least one of the chord constituent notes and a set of phrase waveform data which does not have the at least one of the chord constituent notes but has different one of the chord constituent notes;

an obtaining step of obtaining chord information which identifies chord type and chord root; and a chord note phrase generating step of pitch-shifting one or more of the separated phrase waveform data sets in accordance with at least the chord type identified on the basis of the obtained chord information, and combining the separated phrase waveform data sets including the pitch-shifted phrase waveform data to generate, as accompaniment data, a set of waveform data indicative of a chord note phrase corresponding to the chord root and the chord type identified on the basis of the obtained chord information.

12. The computer-readable medium according to claim 11, wherein the separating step separates the phrase waveform data set having the chord constituent notes into a set of phrase waveform data having two or more of the chord constituent notes and a set of phrase waveform data having one chord constituent note which is included in the chord constituent notes but is different from the two or more of the chord constituent notes.

13. The computer-readable medium according to claim 12, wherein the set of phrase waveform data which is separated by the separating step and has the two or more chord constituent notes has chord constituent notes which are a chord root, a note having an interval of a third, and a note having an interval of a fifth, chord constituent notes which are the chord root and the note having the interval of the fifth, or chord constituent notes which are the chord root and the note having the interval of the third.

14. The computer-readable medium according to claim 11, wherein the separating step has a conditional separating step of separating, if one set of phrase waveform data has both a chord constituent note defined by the chord type identified on the basis of the chord information obtained by the obtaining step and a chord constituent note which is not defined by the chord type, the one set of phrase waveform data into a set of phrase waveform data having the chord constituent note defined by the chord type and a set of phrase waveform data having the chord constituent note which is not defined by the chord type.

15. The computer-readable medium according to claim 11, wherein the separating step separates the set of phrase waveform data into a plurality of phrase waveform data sets each corresponding to different one of the chord constituent notes.

16. The computer-readable medium according to claim 11, wherein the storage device stores one set of phrase waveform data having a plurality of constituent notes of a chord; and the chord note phrase generating step includes:

a first pitch-shifting step of pitch-shifting one or more of the phrase waveform data sets separated by the separating step in accordance not only with the chord type identified on the basis of the chord information obtained by the obtaining step but also with a difference in tone pitch between a chord root included in the one set of phrase waveform data and the chord root identified on the basis of the chord information obtained by the obtaining step;

a second pitch-shifting step of pitch-shifting the set of phrase waveform data which has been separated by the separating step but is different from the one or more phrase waveform data sets in accordance with the difference in tone pitch between the chord root included in the one set of phrase waveform data and the chord root identified on the basis of the chord information obtained by the obtaining step; and a combining step of combining the phrase waveform data pitch-shifted by the first pitch-shifting step and the phrase waveform data pitch-shifted by the second pitch-shifted step.

17. The computer-readable medium according claim 11, wherein the storage device stores one set of phrase waveform data having a plurality of constituent notes of a chord; and the chord note phrase generating step includes:

a first pitch-shifting step of pitch-shifting one or more of the phrase waveform data sets separated by the separating step in accordance with the chord type identified on the basis of the chord information obtained by the obtaining step;

a combining step of combining the one or more of the phrase waveform data sets pitch-shifted by the first pitch-shifting step and phrase waveform data which is included in the phrase waveform data sets separated by the separating step but is different from the one or more of the phrase waveform data sets; and a second pitch-shifting step of pitch-shifting the combined phrase waveform data in accordance with a difference in tone pitch between a chord root included in the one set of phrase waveform data and the chord root identified on the basis of the chord information obtained by the obtaining step.

18. The computer-readable medium according to claim 11, wherein the storage device stores a plurality of phrase waveform data sets each having a plurality of constituent notes of a different chord;

the accompaniment data generation program further includes a selecting step of selecting a set of phrase waveform data having a chord root having the smallest difference in tone pitch between the chord root identified on the basis of the chord information obtained by the obtaining step from among the plurality of phrase waveform data sets;

the separating step separates the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating step includes:

a first pitch-shifting step of pitch-shifting one or more of the phrase waveform data sets separated by the separating step in accordance not only with the chord type identified on the basis of the chord information obtained by the obtaining step but also with a difference in tone pitch between the chord root included in the selected phrase waveform data set and the chord root identified on the basis of the chord information obtained by the obtaining step;

a second pitch-shifting step of pitch-shifting the set of phrase waveform data which has been separated by the separating step but is different from the one or more phrase waveform data sets in accordance with the difference in tone pitch between the chord root included in the selected phrase waveform data set and the chord root identified on the basis of the chord information obtained by the obtaining step; and a combining step of combining the phrase waveform data pitch-shifted by the first pitch-shifting step and the phrase waveform data pitch-shifted by the second pitch-shifted step.

19. The computer-readable medium according to claim 11, wherein the storage device stores a plurality of phrase waveform data sets each having a plurality of constituent notes of a different chord;

the accompaniment data generation program further includes a selecting step of selecting a set of phrase waveform data having a chord root having the smallest difference in tone pitch between the chord root identified on the basis of the chord information obtained by the obtaining step from among the plurality of phrase waveform data sets;

the separating step separates the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating step includes:

a first pitch-shifting step of pitch-shifting one or more of the phrase waveform data sets separated by the separating step in accordance with the chord type identified on the basis of the chord information obtained by the obtaining step;

a combining step of combining the one or more of the phrase waveform data sets pitch-shifted by the first pitch-shifting step and phrase waveform data which is included in the phrase waveform data sets separated by the separating step but is different from the one or more of the phrase waveform data sets; and a second pitch-shifting step of pitch-shifting the combined phrase waveform data in accordance with a difference in tone pitch between the chord root included in the selected phrase waveform data set and the chord root identified on the basis of the chord information obtained by the obtaining step.

20. The computer-readable medium according to claim 11, wherein the storage device stores a set of phrase waveform data having a plurality of constituent notes of a chord for every chord root;

the accompaniment data generation program further includes a selecting step of selecting a set of phrase waveform data corresponding to the chord root identified on the basis of the chord information obtained by the obtaining step from among the plurality of phrase waveform data sets;

the separating step separates the selected phrase waveform data set into sets of phrase waveform data formed of a set of phrase waveform data having at least one of the chord constituent notes and a set of phrase waveform data which does not have the at least one of the chord constituent notes but has different one of the chord constituent notes; and the chord note phrase generating step includes:

a pitch-shifting step of pitch-shifting one or more of the phrase waveform data sets separated by the separating step in accordance with the chord type identified on the basis of the chord information obtained by the obtaining step; and a combining step of combining the one or more of the phrase waveform data sets pitch-shifted by the pitch-shifting step and phrase waveform data which is included in the phrase waveform data sets separated by the separating step but is different from the one or more of the phrase waveform data sets.

* * * * *